US008068768B2

(12) United States Patent
Adachi et al.

(10) Patent No.: US 8,068,768 B2
(45) Date of Patent: Nov. 29, 2011

(54) ION GENERATING ELEMENT, CHARGING DEVICE, AND IMAGE FORMING APPARATUS

(75) Inventors: Katsumi Adachi, Osaka (JP); Shoutaro Okamoto, Osaka (JP); Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 406 days.

(21) Appl. No.: 12/480,850

(22) Filed: Jun. 9, 2009

(65) Prior Publication Data

US 2009/0311008 A1 Dec. 17, 2009

(30) Foreign Application Priority Data

Jun. 11, 2008 (JP) ..... 2008-153062

(51) Int. Cl.
*G03G 15/02* (2006.01)
*G03G 15/16* (2006.01)
*G03G 15/01* (2006.01)
*G03G 15/20* (2006.01)

(52) U.S. Cl. ..... 399/168; 399/296; 399/302; 399/308; 399/310

(58) Field of Classification Search ..... 399/168, 399/296, 302, 308, 310
See application file for complete search history.

(56) References Cited

U.S. PATENT DOCUMENTS 4,783,716 A 11/1988 Nagase et al.
5,367,366 A 11/1994 Kido et al.
5,983,060 A 11/1999 Namekata et al.
2009/0001280 A1* 1/2009 Adachi ..... 250/423 R
2009/0003859 A1* 1/2009 Kagawa et al. ..... 399/50
2009/0039244 A1 2/2009 Kagawa et al.

FOREIGN PATENT DOCUMENTS

JP 61-289365 A 12/1986
JP 63-159883 A 7/1988
JP 64-007071 1/1989
JP 08-160711 6/1996
JP 09-305001 11/1997
JP 10-294163 A 11/1998
JP 11-072990 A 3/1999

(Continued)

OTHER PUBLICATIONS

Co-pending U.S. Appl. No. 12/391,485, filed Feb. 24, 2009.

(Continued)

*Primary Examiner* — David Gray
*Assistant Examiner* — Joseph Wong
(74) *Attorney, Agent, or Firm* — Renner, Otto, Boisselle & Sklar, LLP

(57) ABSTRACT

In an ion generating element, (i) an induction electrode and a heater electrode are provided away from each other on one surface of an insulating base material such that the induction electrode and the heater electrode are insulated from each other, (ii) a dielectric layer is provided on the surface of the insulating base material, and (iii) the dielectric layer has a length covering the insulating base material and the dielectric layer has openings above a ground terminal of the induction electrode and above a ground terminal and a power supply connection terminal of the heater electrode so that the terminals are exposed. As a result, it is possible to provide an ion generating element for generating ions along with creeping discharge, a charging device, and an image forming apparatus, each of which can be produced at low costs and prevent damages when unexpected troubles occur, and each of which is excellent in terms of safety.

9 Claims, 11 Drawing Sheets

FOREIGN PATENT DOCUMENTS

| | | | |
|---|---|---|---|
| JP | 11-194581 | | 7/1999 |
| JP | 2001-093651 | A | 4/2001 |
| JP | 2002-237368 | | 8/2002 |
| JP | 2004-069860 | | 3/2004 |
| JP | 2004-157447 | | 6/2004 |
| JP | 2003-249327 | | 9/2004 |
| JP | 2006-222019 | A | 8/2006 |

OTHER PUBLICATIONS

U.S. Office Action mailed on May 4, 2011 for co-pending U.S. Appl. No. 12/391,485.

* cited by examiner

ION GENERATING ELEMENT, CHARGING DEVICE, AND IMAGE FORMING APPARATUS

This Nonprovisional application claims priority under 35 U.S.C. §119(a) on Patent Application No. 2008-153062 filed in Japan on Jun. 11, 2008, the entire contents of which are hereby incorporated by reference.

TECHNICAL FIELD

The present invention relates to (i) an ion generating element for use in a image forming process, in an image forming apparatus such as a copier, a printer, or a facsimile machine, of (a) developing, with toner, an electrostatic latent image formed on an image bearing member and (b) transferring and fixing the developed image onto a printing medium, and (ii) a charging device and (iii) an image forming apparatus, each including the ion generating element.

More specifically, the present invention relates to (i) an ion generating element (a) for charging a charge receiving material (for example, a photoreceptor) in such a manner that a high alternating voltage is applied between a discharge electrode and an induction electrode, provided on top and back sides of a dielectric member, respectively, so that creeping discharge is caused and intended-polar ions are drawn, or (b) for charging a toner image on an image bearing member (for example, a photoreceptor or an intermediate transfer member) before the toner image is transferred to a transfer receiving body (for example, an intermediate transfer member or recording paper), and (ii) a charging device including the ion generating element. The present invention further relates to an image forming apparatus including the charging device.

BACKGROUND ART

Conventionally, in an image forming apparatus employing an electrophotographic method, a charging device employing a corona discharge method has been used (i) as a charging device for charging a photoreceptor, (ii) as a transfer device for electrostatically transferring a toner image formed on a photoreceptor or the like onto recording paper or the like, (iii) as a removing device for removing recording paper or the like that has electrostatic contact with a photoreceptor or the like, and the like devices.

Such a charging device employing a corona discharge method includes a shield case having an opening facing a charge receiving material, such as a photoreceptor, recording paper, or the like, and a line or saw-like form discharge electrode to be provided in a tensioned state in the shield case. As such a charging device, for example, a so-called corotron for uniformly charging a charge receiving material by generating corona discharge by applying a high voltage to the discharge electrode, or a so-called scorotron for uniformly charging a charge receiving material by applying an intended voltage to a grid electrode provided between the discharge electrode and the charge receiving material (see, for example, Patent Literature 1) is used.

Patent Literatures 2 and 3, for example, disclose such a corona-discharge-type charging device used as a pretransfer charging device for charging a toner image to be transferred to a transfer medium, such as an intermediate transfer member or recording paper, before the toner image is transferred. Even if an amount of charge in the toner image formed on an image bearing member is uneven, the techniques disclosed in Patent Literatures 2 and 3 makes a charge amount of the toner image uniform before its transfer. As a result, it is possible to restrain a decrease in flexibility of a transfer when the toner image is transferred and to stably transfer the toner image onto the transfer medium.

However, such conventional charging devices have a lot of problems. Firstly, such a charging device needs not only a discharge electrode but also a shield case, a grid electrode, and the like. Further, it is necessary to ensure a predetermined distance (10 mm) between the discharge electrode and a charge receiving material. As a result, a lot of space for the charging device to be placed in is required. Generally, a developing device, a first transfer device, and the like devices are provided around a first transfer section, and a photoreceptor, a second transfer device, and the like devices are provided before a second transfer section. Therefore, there is only a small space for a pretransfer charging device to be placed in. For this reason, the conventional corona-discharge-type charging device causes a difficulty in a layout of such constituent devices in an image forming apparatus.

Secondly, the conventional corona-discharge-type charging devices have a problem that a great amount of discharge products such as ozone ($O_3$) and nitrogen oxide (NOx) are generated. Generation of a great amount of ozone causes problems, such as generation of ozone smell, adverse effects on a human body, and deterioration of components due to strong oxidation. Further, generation of nitrogen oxide causes a problem that the nitrogen oxide is attached to a photoreceptor as ammonium salt (ammonium nitrate) and causes a defective image, and the like problems. Especially, an organic photoreceptor (OPC), which is generally used, is easily affected by ozone or NOx and causes image defects such as white spots and image deletions.

In order to prevent these problems, in an intermediate-transfer-type color image forming apparatus having a plurality of transfer members, it is preferable that a pretransfer charging device be provided in an upstream of all the transfer members (a plurality of first transfer members, and a second transfer member). This is preferable from the viewpoint that a charge amount of a toner image becomes uniform before the toner image is transferred. However, from a practical standpoint, the providing of a pretransfer charging device in such a manner is difficult due to a problem of a generation amount of ozone and NOx.

Further, in recent years, for the purpose of decreasing ozone, a contact charging method using a conductive roller, a conductive blush, or the like has been employed in a charging device for charging a photoreceptor itself. However, it is difficult to charge the photoreceptor without making a toner image uneven by such a contact charging method. Accordingly, a charging device employing a non-contact corona discharge method is used as a pretransfer charging device. However, in a case where the conventional corona-discharge-type pretransfer charging device is provided in an image forming apparatus including a contact charging device, an ozoneless effect is not exhibited.

As a technique to reduce a generation amount of ozone, for example, Patent Literature 4 discloses the following charging device. That is, a charging device in Patent Literature 4 includes: multiple discharge electrodes aligned at an approximately predetermined pitch along an axial direction; a high-voltage power supply for applying to the multiple discharge electrodes a voltage of not less than a discharge-initiating voltage; a resistor provided between an output electrode of the high-voltage power supply and the multiple discharge electrodes; a grid electrode provided, close to the multiple discharge electrodes, between the multiple discharge electrodes and a charge receiving material; and a grid power supply for applying a grid voltage to the grid electrode. In the charging device, the multiple discharge electrodes and the grid electrode are provided so that a gap therebetween is not more than 4 mm, thereby reducing a discharge current so that the generation amount of ozone is reduced.

However, although the technique disclosed in Patent Literature 4 can reduce the generation amount of ozone by reducing the discharge current as such, the reduction amount of ozone is still insufficient and around 1.0 ppm of ozone generates. Further, there has been another problem of unstable discharge caused due to attachment of discharge products, toner, paper dusts, or the like to the discharge electrodes, abrasion/deterioration of the heads of the discharge electrodes, or the like factor. Further, it is difficult to clean such discharge products, toner, paper dusts, or the like attached to the discharge electrodes because of the shape of the discharge electrodes.

Besides, a gap between the discharge electrodes and the charge receiving material is so narrow that unevenness in charge in a longitudinal direction (in a direction along the pitches between the discharge electrodes) is easily caused due to the pitches between the multiple discharge electrodes. There is another considerable method in which pitches between discharge electrodes are formed small to prevent such unevenness in charge. However, this increases production costs because the number of discharge electrodes is increased.

In view of the problems of the conventional charging devices, Patent Literature 5, for example, discloses a charging device including an ion generating element (a creeping discharge element) that includes: a discharge electrode having pointed protrusions in an outer circumference thereof and an induction electrode, the electrodes being provided so as to sandwich a dielectric member therebetween. The ion generating element generates ions by applying a high alternating voltage between these electrodes (hereinafter, this charge method is referred to as a creeping discharge method).

The creeping discharge type charging device is small because the device does not include a shield case, a grid electrode, and the like. Further, since a discharge surface is flat, the charging device is easily cleaned and excellent in maintenance.

A discharging characteristic of the ion generating element (the creeping discharge element) tends to decline under a high humidity condition. In view of this problem, for example, Patent Literatures 6 and 7 disclose techniques for improving the discharging characteristic by providing an ion generating element with a heater member and heating the ion generating element to remove absorption moisture in a discharge region. Especially, Patent Literature 7 discloses a technique in which an induction electrode generates Joule heat while a power is being supplied to the induction electrode, so that the induction electrode also works as a heater. With the technique disclosed in Patent Literature 7, it is possible to make the ion generating element small and to reduce costs, in comparison with a technique in which a heater element is separately provided.

CITATION LIST

Patent Literature 1

Japanese Patent Application Publication, Tokukaihei, No. 6-11946 (Publication Date: Jan. 21, 1994)

Patent Literature 2

Japanese Patent Application Publication, Tokukaihei, No. 10-274892 (Publication Date: Oct. 13, 1998)

Patent Literature 3

Japanese Patent Application Publication, Tokukai, No. 2004-69860 (Publication Date: Mar. 4, 2004)

Patent Literature 4

Japanese Patent Application Publication, Tokukaihei, No. 8-160711 (Publication Date: Jun. 21, 1996)

Patent Literature 5

Japanese Patent Application Publication, Tokukai, No. 2003-249327 (Publication Date: Sep. 5, 2003)

Patent Literature 6

Japanese Patent Application Publication, Tokukai, No. 2004-157447 (Publication Date: Jun. 3, 2004)

Patent Literature 7

Japanese Patent Application Publication, Tokukai, No. 2002-237368 (Publication Date: Aug. 23, 2002)

Patent Literature 8

Japanese Patent Publication Application, Tokukaihei, No. 9-305001 (Publication Date: Nov. 28, 1997)

SUMMARY OF INVENTION

Technical Problem

However, in a case of an ion generating element including the aforementioned heater electrode (heater line), there are problems described below.

Firstly, the following explains about the problems. (a) of FIG. 10 illustrates an ion generating element having a structure in which an induction electrode 23 and a heater electrode 25 are provided on an insulating base material, and a discharge electrode 22 is provided above them via a dielectric layer provided therebetween. A high alternating voltage is to be applied to the discharge electrode 22. An end of the heater electrode 25 is connected to a heater power supply 34, and the other end of the heater electrode 25 and the induction electrode 23 are connected to the ground potential via a common ground terminal 26.

In normal use, while a high alternating voltage is being applied to the discharge electrode 22, an induction current is induced to the induction electrode 23 from the ground potential. As the voltage applied to the discharge electrode 22 varies, the induction current flows through the induction electrode 23. For example, in a case where a pulsing voltage is applied to the discharge electrode, as shown in FIG. 11, currents flowing into the discharge electrode 22 and the induction electrode 23 form spike-like current waveforms. This is because a condenser component constituted by the dielectric layer sandwiched between the discharge electrode 22 and the induction electrode 23 is being charged during short time when the voltage is rising. After the voltage becomes constant, the induced current does not flow. However, when the voltage falls, a reverse spike-like current is generated, in an adverse manner to the above. The spike-like current component includes a current component caused by discharge. However, an amount of the current component caused by discharge is slight with respect to that of the flowing current that is not caused by discharge. Further, in a case of a Sin-wave current (not shown), a sine wave induction current having a 90°-phase difference with respect to the application voltage flows.

Since the induction electrode 23 is connected to the ground potential, its potential is almost zero. On the other hand, a comparatively low voltage of a few to tens of volts is applied to the heater electrode 25, thereby causing a current to flow from a terminal connected to the heater power supply 34 toward the terminal for the ground potential, so that Joule heat is generated. The ion generating element 10 is heated with the Joule heat.

Secondly explained is a phenomenon as a problem, with reference to (b) of FIG. 10. (b) of FIG. 10 illustrates a case where the common ground terminal 26 of the induction electrode 23 and the heater electrode 25 causes an accident such as a poor contact and becomes floating. In this case, when a high voltage is applied to the discharge electrode 22, an induction electrode potential is affected by a discharge electrode potential, thereby causing the induction electrode potential to be unstable. Further, the induction current flows into the heater power supply 34 through the heater electrode 25. In such a case, an unstable voltage affects the heater power supply 34, thereby inducing a noise generation, causing a damage on the heater power supply 34, and furthermore, causing troubles such as firing.

In view of the above problems, there is a method in which the induction electrode 23 is insulated from the heater electrode 25, as illustrated in (c) of FIG. 10. With the arrangement, even if the induction electrode 23 becomes floating due to some troubles, it is still possible to prevent that the heater power supply 34 or a main body of a machine is damaged via the heater electrode 25. Thereby, it is possible to prevent troubles such as firing from occurring.

However, in order that the ion generating device satisfactorily works as above, the ion generating element requires four terminals: a terminal for the discharge electrode 22; a terminal for the induction electrode 23; and two terminals for the heater electrode 25. FIG. 4 illustrates an exemplary arrangement of an ion generating element in which an induction electrode 23 is isolated from a heater electrode 25. (a-1) of FIG. 4 is a plane view of a dielectric layer 21*a* on which a discharge electrode 22 is provided, and (a-2) of FIG. 4 is a side view of (a-1) of FIG. 4. (b-1) of FIG. 4 is a plane view of an insulating base material 21*b* on which induction electrode 23 and a heater electrode 25 are provided, and (b-2) of FIG. 4 is a side view of (b-1) of FIG. 4. (c-1) of FIG. 4 is a plane view of an ion generating element 10, and (c-2) of FIG. 4 is a side view of (c-1) of FIG. 4. The dielectric layer 21*a* illustrated in (a-1) and (a-2) of FIG. 4 is laminated on the insulating base material 21*b* illustrated in (b-1) and (b-2) of FIG. 4 so that the ion generating element 10 is structured such that the discharge electrode 22 is provided in a surface layer and the induction electrode 23 and the heater electrode 25 are internally provided via the dielectric layer 21*a*.

An electrical connection to the ion generating element 10 can be carried out in such a manner that a power-feeing terminal has direct contact with the discharge electrode 22, because the discharge electrode 22 is exposed. On the other hand, in regard to the induction electrode 23 and the heater electrode 25 that are internally provided, their terminals are necessary to be exposed to a top or back surface of the ion generating element 10. For example, with the use of a through-hall technique used for a multilayer board, it is possible to form these terminals on a surface of the dielectric layer 21*a* on which surface the discharge electrode 22 is provided, or on a surface of the insulating base material 21*b* on which surface the electrodes are not provided. However, in this case, it is necessary to form a through hall(s) and to form patterns for the terminals, thereby increasing costs. Further, the insulating base material has a thickness to a certain degree from the viewpoint of an improvement in the strength of the element. However, in a case where an opening(s) is (are) provided in the insulating base material, the strength of the element may largely decrease.

In view of these problems, as shown in (a-1) of FIG. 4, the dielectric layer 21*a* is shortened at both ends so that the terminals of the induction electrode 23 and the heater electrode 25 on the insulating base material 21*b* are not covered, thereby making it possible to easily carry out power feeding to the internally-provided electrodes, at low costs.

However, it was found out that the structure in which the dielectric layer 21*a* is shortened at both ends had the following problem. The dielectric layer 21*a* is shortened at both ends so that the terminals of the induction electrode 23 and the heater electrode 25 are exposed, as shown in (a-1) of FIG. 4. In this case, the dielectric layer 21*a* has stepwise structure at the both ends. In case where some external forces are added to the element during assembling of the element or attaching or removing of the element, the stepwise parts easily receive stress and cracks may be caused around the stepwise parts. This problem is more markedly caused in a case where an insulating base material and a dielectric layer are made from ceramic, glass, or the like material.

The present invention is accomplished in view of the above problems. An object of the present invention is to provide an ion generating element for generating ions along with creeping discharge, a charging device, and an image forming apparatus, each of which can be produced at low costs and prevent damages on the occurrence of unexpected troubles, and each of which is excellent in terms of safety.

Solution to Problem

In order to achieve the above object, an ion generating element of the present invention includes a heater electrode for heating the ion generating element with Joule heat generated while a power is supplied to the heater electrode, the heater electrode and an induction electrode being provided away from each other on one surface of an insulating base material so that the heater electrode and the induction electrode are insulated from each other, a dielectric layer being laminated on the surface of the insulating base material, the dielectric layer having a length covering the insulating base material and the dielectric layer having openings above a terminal of the induction electrode and above terminals of the heater electrode so that the terminals are exposed.

Advantageous Effects of Invention

In the arrangement of the present invention, the induction electrode and the heater electrode are surrounded by the dielectric layer and the insulating base material. As a result, creeping leakage from the discharge electrode to the induction electrode or the heater electrode hardly occurs, thereby making it possible to stabilize a discharge performance by removing absorption moisture in the vicinity of the discharge electrode with Joule heat generated while a power is being supplied to the heater electrode. Further, the above arrangement is simple so that it is possible to provide an ion generating element at low costs.

Moreover, in the arrangement of the present invention, the induction electrode and the heater electrode are provided away from each other so that they are insulated from each other. As a result, even if the induction electrode is floating (is not connected to the ground), it is possible to avoid damages to an entire apparatus through the heater electrode. Since the leakage to the heater electrode can be prevented as such, no damage to the heater power supply is caused and troubles like breakage and fire of a main body of a machine including the ion generating element can be prevented. As a result, it is possible to provide an ion generating element that is excellent in terms of safety. Further, in the arrangement of the present invention, the dielectric layer has a length covering the insulating base material. Accordingly, no step is formed along a width direction of the element. As a result, even if some external forces are added to the ion generating element, it is possible to prevent occurrence of cracks of the element. Furthermore, the dielectric layer has openings above the terminal of the induction electrode and above the terminals of the heater electrode so that these electrodes are exposed. Consequently, it is possible to provide, at low costs, a highly reliable ion generating element. Further, since the openings are provided in the dielectric layer that is originally thin, effects on a decrease in the strength of the entire element are small, in comparison with a case where such openings are provided in the insulating base material.

In this way, with the arrangement of the present invention, it is possible to prevent damages when unexpected troubles occur and to provide, at low costs, an ion generating element that is excellent in terms of safety.

Additional objects, features, and strengths of the present invention will be made clear by the description below. Further, the advantages of the present invention will be evident from the following explanation in reference to the drawings.

BRIEF DESCRIPTION OF DRAWINGS

FIG. 3(*b*) is a cross sectional view illustrating an ion generating element that is connected to a power supply.

DESCRIPTION OF EMBODIMENTS

Embodiments

One embodiment of (i) an ion generating element of the present invention, (ii) a charging device, of the present invention, including the ion generating element, and (iii) an image forming apparatus including the charging device is described below with reference to FIGS. 1 through 11 in detail. The following embodiment is an example to embody the present invention, and does not limit the technical scope of the present invention.

[Overall Arrangement of Image Forming Apparatus]

Figure 2:
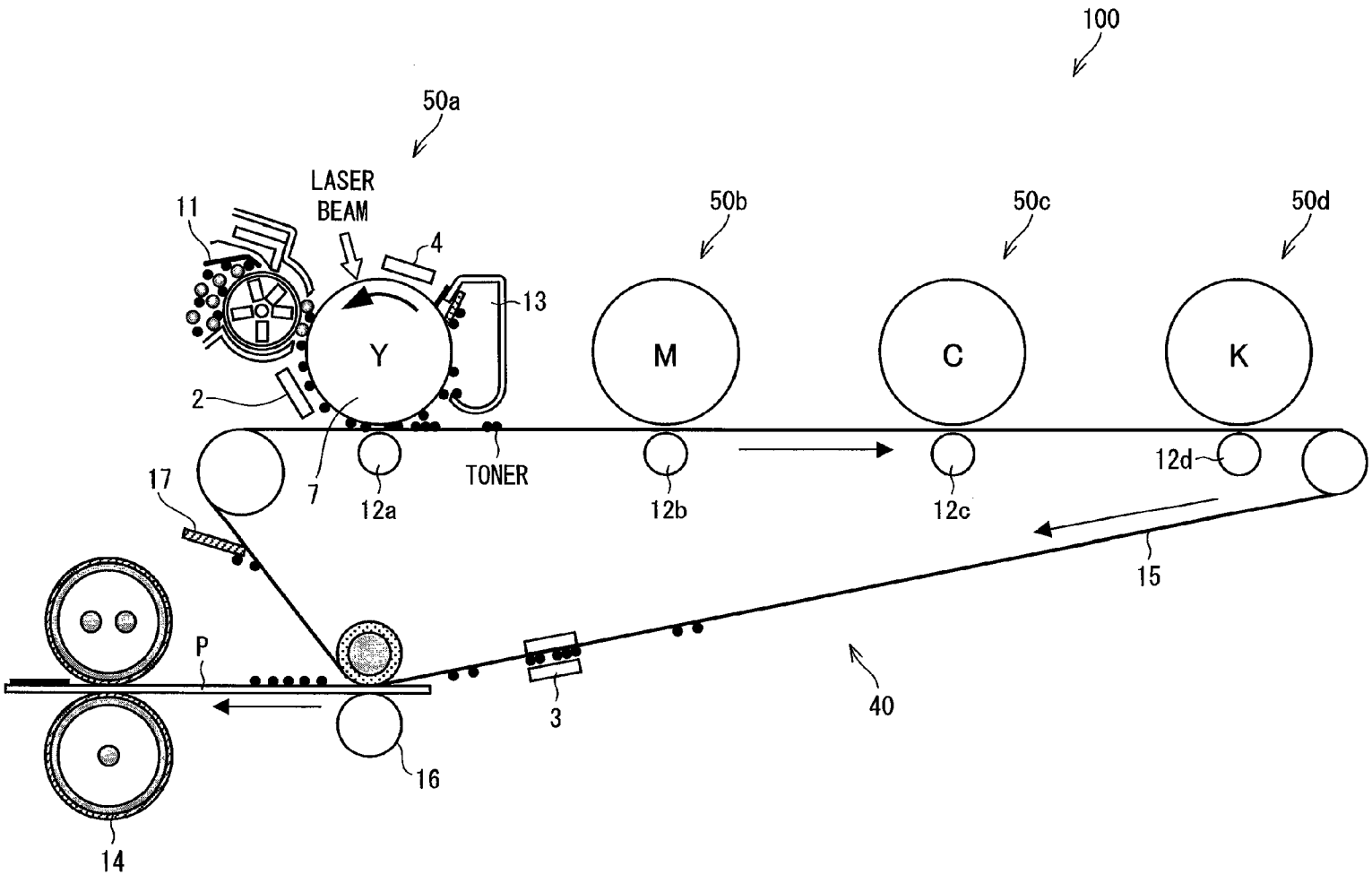
FIG. 2 illustrates an arrangement of essential part of an image forming apparatus according to the present invention.

Firstly explained is an overall arrangement of an image forming apparatus in the present embodiment. FIG. 2 is a cross sectional view schematically illustrating an image forming apparatus 100 including a pretransfer charging device according to the present embodiment. The image forming apparatus 100 employs a so-called tandem mode and is a printer employing an intermediate transfer method. The image forming apparatus 100 can form a full-color image.

As illustrated in FIG. 2, the image forming apparatus 100 includes visible image forming units 50*a* through 50*d* for four colors (C, M, Y, K), a transfer unit 40, and a fixing device 14.

The transfer unit 40 includes an intermediate transfer belt 15 (an image bearing member), four first transfer devices 12*a* through 12*d* provided on an inner periphery of the intermediate transfer belt 15, a charging device 3 for charging before a second transfer, a second transfer device 16, and a transfer cleaning device 17.

Each of the visible image forming units 50*a* through 50*d* visualizes a toner image for each color, and thus visualized toner image is transferred onto the intermediate transfer belt 15 such that the visualized toner images for four colors overlap each other. The intermediate transfer belt 15 retransfers the toner images that have been transferred thereon, onto a recording paper P. More specifically, the intermediate transfer belt 15 is an endless belt that is suspended by a pair of a driving roller and an idling roller and is controlled to carry out a transfer at a predetermined peripheral speed (167 to 225 mm/s, in the present embodiment) in forming an image.

The first transfer devices 12*a* through 12*d* are provided for the visible image forming units 50*a* through 50*d*, respectively. Each of the first transfer devices 12*a* through 12*d* transfers a toner image onto the intermediate transfer belt when a bias voltage having a polarity opposite to that of the toner image formed on a surface of a photoreceptor drum 7 is being applied. Each of the first transfer devices 12*a* through 12*d* is placed so as to face each of the visible image forming units 50*a* through 50*d* such that the intermediate transfer belt 15 is sandwiched therebetween.

The charging device 3 for charging before a second transfer recharges the toner images that have been transferred onto the intermediate transfer belt 15 so that the toner images overlap each other. Details of the charging device 3 will be described later, but the charging device 3 charges a toner image by emitting ions, in the present embodiment.

The second transfer device 16 retransfers the toner images that have been transferred onto the intermediate transfer belt 15, onto a recording paper P. The second transfer device 16 is provided so as to have contact with the intermediate transfer belt 15. The transfer cleaning device 17 cleans a surface of the intermediate transfer belt 15 that has retransferred the toner images.

In a periphery of the intermediate transfer belt 15 of the transfer unit 40, the first transfer devices 12*a* through 12*d*, the charging device 3 for a second transfer, the second transfer device 16, and the transfer cleaning device 17 are provided in this order from a upstream in a carrying direction of the intermediate transfer belt 15.

A fixing device 14 is provided on a downstream side of the second transfer device 16 in a carrying direction of a recording paper P. The fixing device 14 fixes, to the recording paper P, the toner images transferred onto the recording paper P.

Further, the four visible image forming units 50*a* through 50*d* are provided so as to have contact with the intermediate transfer belt 15 along a carrying direction of the belt. The four visible image forming units 50*a* through 50*d* have the same structure except for toner colors to be used. The toner colors of the visible image forming units 50*a* through 50*d* are yellow (Y), magenta (M), cyan (C), and black (K), respectively. The following deals with the visible image forming unit 50*a*, and explanations about the other visible image forming units 50*b* through 50*d* are omitted. For this reason, FIG. 2 illustrates only members in the visible image forming unit 50*a*. However, the other visible image forming units 50*b* through 50*d* also include the same members.

The visible image forming unit 50*a* includes: (i) a photoreceptor drum (image bearing member) 7; and (ii) a latent image charging device 4, a laser writing unit (not shown), a developing device 11, a charging device 2 for charging before a first transfer, a cleaning device 13, and the like devices, each provided in a periphery of the photoreceptor drum.

The latent image charging device 4 charges a surface of the photoreceptor drum 7 so that the photoreceptor drum 7 has a predetermined potential. Details of the latent image charging device 4 will be described later, but in the present embodiment, the latent image charging device 4 emits ions and charges the photoreceptor drum by the ions.

The laser writing unit irradiates (exposes) the photoreceptor drum 7 with a laser beam based on image data received from an external device and writes an electrostatic latent image on the uniformly charged photoreceptor drum 7 by scanning a light image.

The developing device 11 provides toner to the electrostatic latent image formed on the surface of the photoreceptor drum 7 and develops the electrostatic latent image so as to form a toner image.

The charging device 2 for charging before a first transfer recharges the toner image formed on the surface of the photoreceptor drum 7, before the toner image is transferred. Details of the charging device 2 will be described later, but in the present embodiment, the charging device 2 charges a toner image by emitting ions.

The cleaning device 13 removes and collects residual toner on the photoreceptor drum 7 from which the toner image has been transferred onto the intermediate transfer belt 15, so that a new electrostatic latent image and a new toner image can be formed on the photoreceptor drum 7.

In a periphery of the photoreceptor drum 7 of the visible image forming unit 50*a*, the latent image charging device 4, the laser writing unit, the developing device 11, the charging device 2 for charging before a first transfer, the first transfer device 12*a*, and the cleaning device 13 are provided in this order from an upstream in a rotating direction of the photoreceptor drum 7.

Next will be described an image forming operation of the image forming apparatus 100. An operation of the visible image forming unit will be described with reference to the constituent members (which have the above reference signs) of the visible image forming unit 50*a*. The visible image forming units 50*b* through 50*d* operate in the same manner as the visible image forming unit 50*a*.

Firstly, the image forming apparatus 100 receives image data from an external device (not shown). A driving unit (not shown) in the image forming apparatus 100 rotates the photoreceptor drum 7 in a direction shown by an arrow in FIG. 2 at a predetermined speed (167 to 225 mm/s, in the present embodiment). Meanwhile, the latent image charging device 4 charges a surface of the photoreceptor drum 7 to a predetermined potential.

Then, the laser writing unit exposes the surface of the photoreceptor drum 7 in accordance with the received image data and writes, to the surface of the photoreceptor drum 7, an electrostatic latent image on the basis of the image data. The developing device 11 supplies toner to the electrostatic latent image formed on the surface of the photoreceptor drum 7. Herewith, the toner adheres to the electrostatic latent image and a toner image is formed.

The toner image thus formed on the surface of the photoreceptor drum 7 is recharged by the charging device 2 for charging before a first transfer. Then, a bias voltage having a polarity opposite to that of the toner image formed on the photoreceptor drum 7 is applied to the first transfer device 12*a*, thereby causing the toner image thus recharged by the charging device 2 for charging before a second transfer to be transferred onto the intermediate transfer belt (a first transfer).

The visible image forming units 50*a* through 50*d* sequentially carry out the above operation so that toner images for four color (Y, M, C, K) overlap each other on the intermediate transfer belt 15.

The toner images overlapping each other are carried to the charging device 3 for charging before a second transfer by the intermediate transfer belt 15. The charging device 3 recharges thus carried toner images. Then, the second transfer device 16 presses the intermediate transfer belt 15 that bears the recharged toner images, against a recording paper P, which is fed from a paper-feeding unit (not shown). Subsequently, a voltage having a polarity opposite to that of toner charge is applied to the second transfer device 16 so that the toner images are transferred onto the recording paper P (a second transfer).

After that, the fixing device 14 fixes the toner images to the recording paper P, and the recording paper P on which the image has been recorded is outputted to a paper output unit. Residual toner left on the photoreceptor drum 7 after the first transfer is removed and collected by the cleaning device 13, and residual toner left on the intermediate transfer belt 15 after the second transfer is removed and collected by the transfer cleaning device 17. This operation allows the image forming apparatus 100 to appropriately perform printing on the recording paper P.

[Exemplary Arrangement of Pretransfer Charging Device]

The following deals with an arrangement of a pretransfer charging device in detail. The charging device 2 for charging before a first transfer, the latent image charging device 4, and the charging device 3 for charging before a second transfer are arranged in the same manner except that the devices are provided at different positions, respectively. In the latent image charging device 4, a grid electrode for controlling a charge potential may be provided between an ion generating element (a creeping discharge device) 1 as described below and the photoreceptor drum 7. The grid electrode is preferably positioned such that a distance from the grid electrode to the photoreceptor drum 7 is about 1 mm and a distance from the grid electrode to the ion generating element 1 is about 2 to 10 mm. The following deals with the charging device 3 for charging before a second transfer in detail, and explanations about the charging device 2 for charging before a first transfer and the latent image charging device 4 are omitted.

Figure 3:
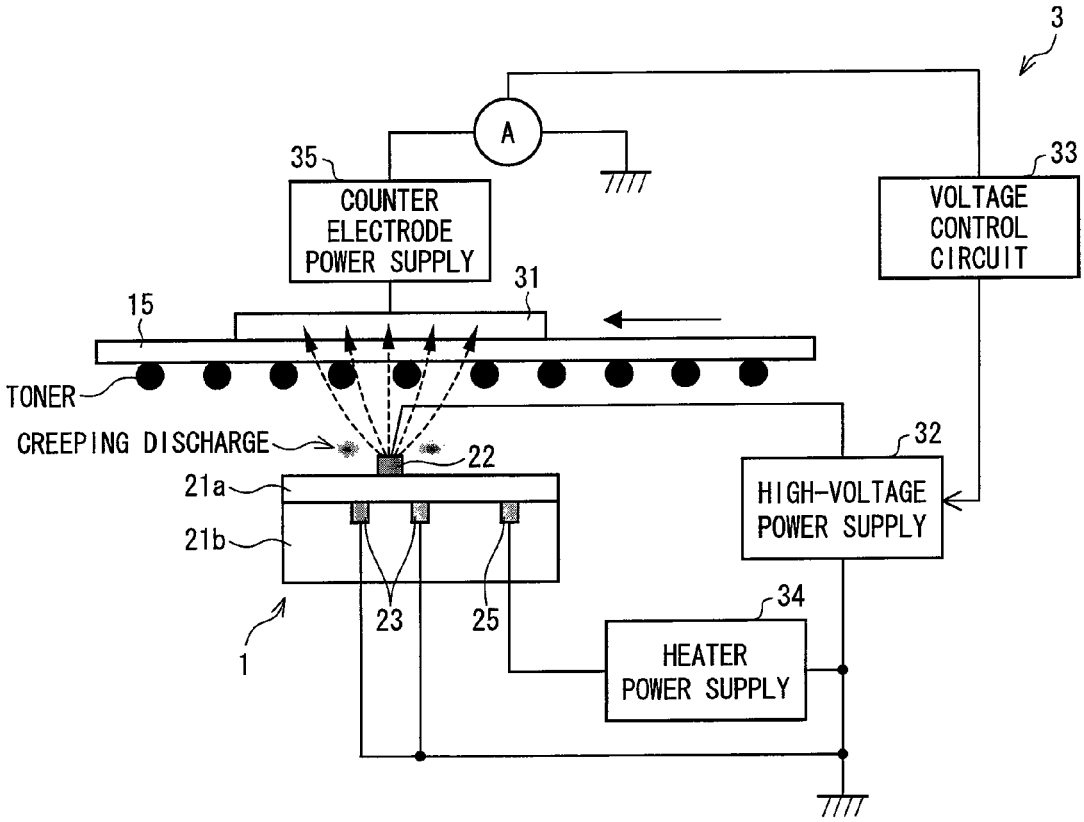
FIG. 3(*a*) illustrates an arrangement of a charging device according to the present invention.
Figure 3:
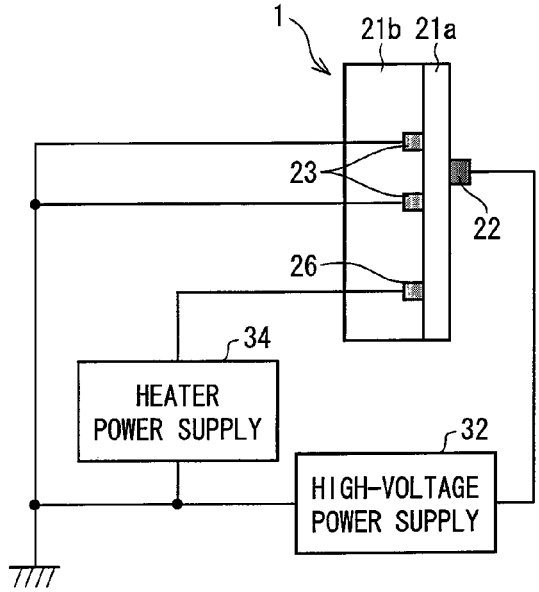

FIG. 3(*a*) illustrates an arrangement of a charging device 3 for charging before a second transfer, which includes an ion generating element 1 provided in the vicinity of an intermediate transfer belt 15. FIG. 3(*b*) is a side view of the ion generating element 1 that is connected to a power supply. Further, (a) of FIG. 1 is a plane view of the ion generating element 1, (b) of FIG. 1 is a side view, in a short direction, of the ion generating element 1, and (c) of FIG. 1 is a side view, in a longitudinal direction, of the ion generating element 1.

As illustrated in FIG. 3(*a*), the charging device 3 for charging before a second transfer includes an ion generating element 1, a counter electrode 31, a high-voltage power supply 32, and a voltage control circuit 33.

Figure 1:
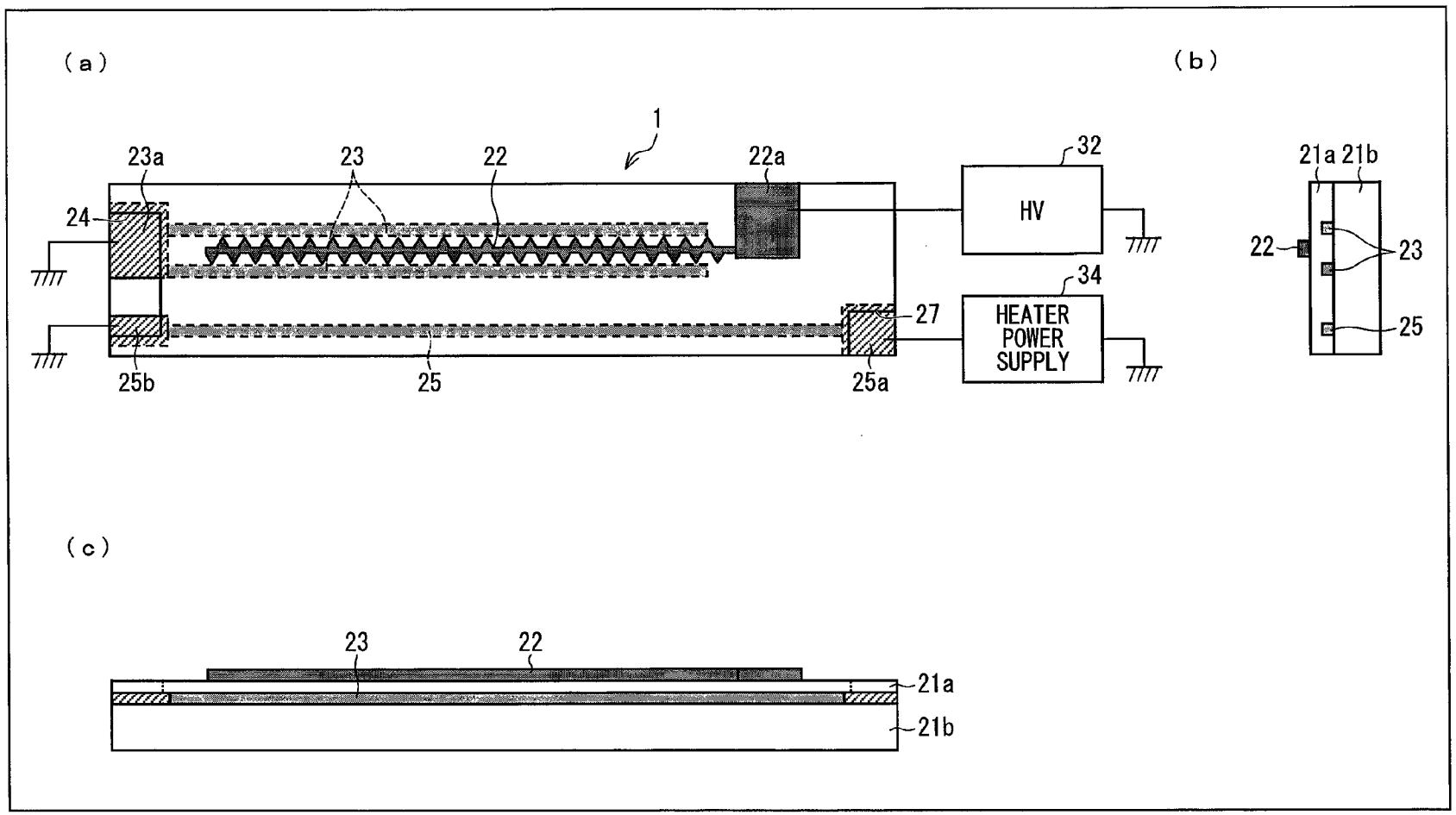
FIG. 1 illustrates an ion generating element of one embodiment of the present invention: (a) of FIG. 1 is a plane view of the ion generating element; (b) of FIG. 1 is a side view, in a short direction, of the ion generating element; and (c) of FIG. 1 is a side view, in a longitudinal direction, of the ion generating element.

The ion generating element 1 includes, as illustrated in FIG. 1: a dielectric layer 21*a*; a discharge electrode 22; an insulating base material 21*b*; an induction electrode 23; and a heater electrode 25. The ion generating element 1 generates ions by discharge caused due to a potential difference between the discharge electrode 22 and the induction electrode 23 (corona discharge generated in the vicinity of the discharge electrode 22 in a direction along a creepage surface of the dielectric layer 21*a*)

The ion generating element 1 is formed in a plate-like shape by attaching the dielectric layer 21*a* and the insulating base material 21*b* that are substantially rectangular. A material of the dielectric layer 21*a* and the insulating base material 21*b* is preferably a material excellent in oxidation resistance in a case where the material is an organic material. Examples of the material may be resin such as polyimide or glass epoxy. In a case where an inorganic material is used, the material can be a mica laminate material, alumina, crystallized glass, forsterite, and ceramic such as steatite. From the viewpoint of corrosion resistance, the above organic material is preferably used as the material of the dielectric layer 21*a* and the insulating base material 21*b*. Furthermore, from the viewpoint of formability, easiness in forming an electrode (later described), low moisture resistance, ceramic is preferable to form the dielectric layer 21*a* and the insulating base material 21*b*. Moreover, it is desirable that insulation resistance between the discharge electrode 22 and the induction electrode 23 be uniform. In this regard, in each of the dielectric layer 21*a* and the insulating base material 21*b*, the less a density inside the material varies and the more uniform an insulation ration becomes, the more preferable dielectric layer 21*a* or insulating base material 21*b* can be obtained. A thickness of the dielectric layer 21*a* is preferably 50 to 250 μm, but the thickness is not limited to this.

The dielectric layer 21*a* has such a length that the dielectric layer 21*a* can cover the insulating base material 21*b*. Further, explained later though, the dielectric layer 21*a* has openings 24 and 27 positioned above a ground terminal 23*a* of the induction electrode 23 and above a ground terminal 25*b* of the heater electrode 25, and above a power supply connection terminal 25*a* of the heater electrode 25, respectively, so that these terminals are exposed. In the present embodiment, the opening 24 is a single opening provided above the ground terminal 23*a* of the induction electrode and above the ground terminal 25*b* of the heat electrode. However, as described later in Example 2, individual openings may be provided for the terminals. The ground terminal 23*a* of the induction electrode 23 and the ground terminal 25*b* and the power supply connection terminal 25*a* of the heater electrode 25 are provided at ends of the insulating base material 21*b* in a longitudinal direction. The dielectric layer 21*a* extends, in an extending direction of the terminals, to a position that can cover the terminals, and has the openings 24 and 27 above the terminals so that the terminals are exposed.

The discharge electrode 22 is formed on a surface of the dielectric layer 21*a* so as to be integrated with the dielectric layer 21*a*. Further, the discharge electrode 22 includes a high-voltage power supply connection terminal 22*a*. A material of the discharge electrode 22 is, for example, a material having conductivity, such as tungsten, silver, gold, platinum, or stainless steel, provided that the material must not cause deformation such as melting or scattering due to discharge. In order to restrain deformation or deterioration of the discharge electrode 22 due to use for ages, the discharge electrode 22 may be coated with thin ceramic, glass, or the like. However, if the coating is not uniform, excessive discharge may be generated at a part that is thinly coated or not coated, while sufficient discharge may be not obtained at a part that is too thickly coated. This causes nonuniform image. In order to prevent such a problem, a uniform coating is necessary.

It is preferable that the discharge electrode 22 have a uniform depth from a surface of the dielectric layer 21*a* (in a case where the discharge electrode 22 is formed from the surface of the dielectric layer 21*a* toward the induction electrode 23) or a uniform thickness (in a case where the discharge electrode 22 is provided so as to protrude from the surface of the dielectric layer 21*a*). A shape of the discharge electrode 22 is not limited provided that the discharge electrode 22 uniformly extends in a direction perpendicular to a direction in which the intermediate transfer belt 15 moves. However, it is preferable that the discharge electrode 22 have a shape that easily causes concentration of an electric field between the discharge electrode 22 and the induction electrode 23, if possible. This is because such a shape allows discharge to be generated between these electrodes even if a voltage applied between the discharge electrode 22 and the induction electrode 23 is low. In the present embodiment, as illustrated in (a) of FIG. 1, the discharge electrode 22 has a comb shape, which easily causes discharge. Although the discharge electrode 22 has a comb shape in the present embodiment, the discharge electrode 22 may be a rectangular electrode that extends in a longitudinal direction of the dielectric layer 21*a*, as in the arrangements illustrated in FIGS. 4 through 9.

The induction electrode 23 is provided between the dielectric layer 21*a* and the insulating base material 21*b* so as to face the discharge electrode 22. This is because it is preferable that (i) insulation resistance between the discharge electrode 22 and the induction electrode 23 be uniform and (ii) the discharge electrode 22 and the induction electrode 23 be provided in parallel to each other. This arrangement allows a distance (hereinafter, referred to as a distance between the electrodes) between the discharge electrode 22 and the induction electrode 23 to be constant, thereby resulting in that a discharge state between the discharge electrode 22 and the induction electrode 23 becomes stable and ions can be optimally generated. In the arrangement illustrated in FIG. 1, the induction electrode 23 is constituted by two line-shaped electrodes, which are placed opposite to each other so as to sandwich the discharge electrode 22 therebetween along a longitudinal direction such that the dielectric layer 21*a* is sandwiched between the two line-shaped electrodes and the discharge electrode 22. The induction electrode 23 of the two line-shaped electrodes includes a ground terminal 23*a* at one end thereof. The ground terminal 23*a* is connected to the ground potential (ground). The induction electrode 23 is not limited to the above shape. The induction electrode 23 may be a plane electrode provided so as to face the discharge electrode, or may be provided only at a part opposite to one end of the discharge electrode 22.

The induction electrode 23 can be provided on a back surface of the dielectric layer 21*a* that is provided as a single layer. However, in this case, it is necessary to ensure a sufficient creeping distance with respect to an application voltage or alternatively to coat the discharge electrode 22 or the induction electrode 23 with an insulating coating layer (a protection layer), so as to prevent leakage between the discharge electrode 22 and the induction electrode 23 via the surface of the dielectric layer 21*a*. Further, as has been already described, it is necessary that the dielectric layer 21*a* have a thin thickness so that discharge is easily caused. Therefore, with only the dielectric layer 21*a* and the coating layer, the strength is not sufficient. In view of this problem, in the present embodiment, a ceramic base material having a thickness of a few hundred μm to a few mm is used as the insulating base material 21*b*, and patterns of the induction electrode 23 and the heater electrode 25 are formed thereon. Then, the dielectric layer 21*a* on which the discharge electrode 22 is attached to the insulating base material 21*b* by pressure so as to be laminated, and firing is carried out thereto. Thus, the ion generating element 1 is formed. The arrangement solves the problem of the strength. Further, in the arrangement, since the induction electrode 23 and the heater electrode 25 are included in the insulating base material 21*b*, it is possible to prevent the creeping leakage from the discharge electrode 22 provided on the surface of the dielectric layer 21*a* to the induction electrode 23 and the heater electrode 25 that are internally provided. Further, since the ion generating element 1 is structured such that two ceramic base materials on which electrode patterns are formed are laminated and fired, it is possible to easily produce the ion generating element 1 at low costs.

The heater electrode 25 is provided in a line shape between the dielectric layer 21*a* and the insulating base material 21*b*, independently from the induction electrode 23. A pattern of the heater electrode 25 is not limited to the line shape, but may be a loop shape or a waveform. Further, a width and a thickness of the heat electrode 25 may be adjusted, as appropriate, to be a suitable condition according to a resistance ratio of a material for the electrode. In view of restraining costs of a heater power supply 34, it is preferable that the heater electrode 25 can be driven by a common voltage (for example, 5, 12, 24 V) used in a main body of an image forming apparatus. In a case where resistance should be increased to obtain a desired input voltage, if the heater electrode 25 is formed with an extremely thin line width, breaking of a wiring line may occur during production. In order to avoid that, a suitable method of wiring may be adopted as appropriate. For example, the heater electrode 25 may be formed in a loop shape with a rather thick width so that the wiring line becomes long.

The heater electrode 25 includes a ground terminal 25*b* at an end thereof, and the ground terminal 25*b* is connected to the ground potential (ground). Further, the heater electrode 25 includes a power supply connection terminal 25*a* at the other end thereof, and the power supply connection terminal 25*a* is connected to the heater power supply 34. In (a) of FIG. 1, the ground terminal 25*b* of the heater electrode is provided close to the ground terminal 23*a* of the induction electrode, but the formation is not limited to this. The power supply connection terminal 25*a* of the heater electrode may be provided close to the ground terminal 23*a* of the induction electrode, alternatively.

While the heater power supply 34 applies a predetermined voltage (12V, in the present embodiment) to the heater electrode 25, the heater electrode 25 generates heat due to Joule heat. Examples of a voltage applying method are a method for continuously applying a direct voltage, a method for applying a voltage by changing a common direct voltage in a machine by a regulator, a method for feeding a power by causing a pulsing voltage by a switching element such as a transistor, and the like method. By combining resistance of the heater electrode 25 with these voltage applying methods, it is possible to appropriately control generation of heat depending on a state such as a starting-up state, a steady state, a change due to use for ages, or an environmental state. By causing the heater electrode 25 to generate heat as such, a temperature of the ion generating element 1 is increased (to about 60° C., in the present embodiment), thereby restraining moisture absorption of the ion generating element 1. As a result, it is possible to stably generate ions under a high humidity condition. In a case where the dielectric layer 21*a* is made from ceramic, the dielectric layer 21*a* itself does not absorb moisture. However, when dew condensation occurs on a surface of the dielectric layer 21*a*, a discharge characteristic decreases. In this regard, it is effective to prevent dew condensation or to eliminate dewdrops by heat generated by the heater.

A material of the induction electrode 23 and the heater electrode 25 may be, for example, a conductive material such as tungsten, silver, silver palladium, gold, platinum, or stainless steel. Further, each of the terminals may be subjected to a gold plating (NiAu plating) treatment in which nickel is applied as an undercoating layer.

Figure 5:
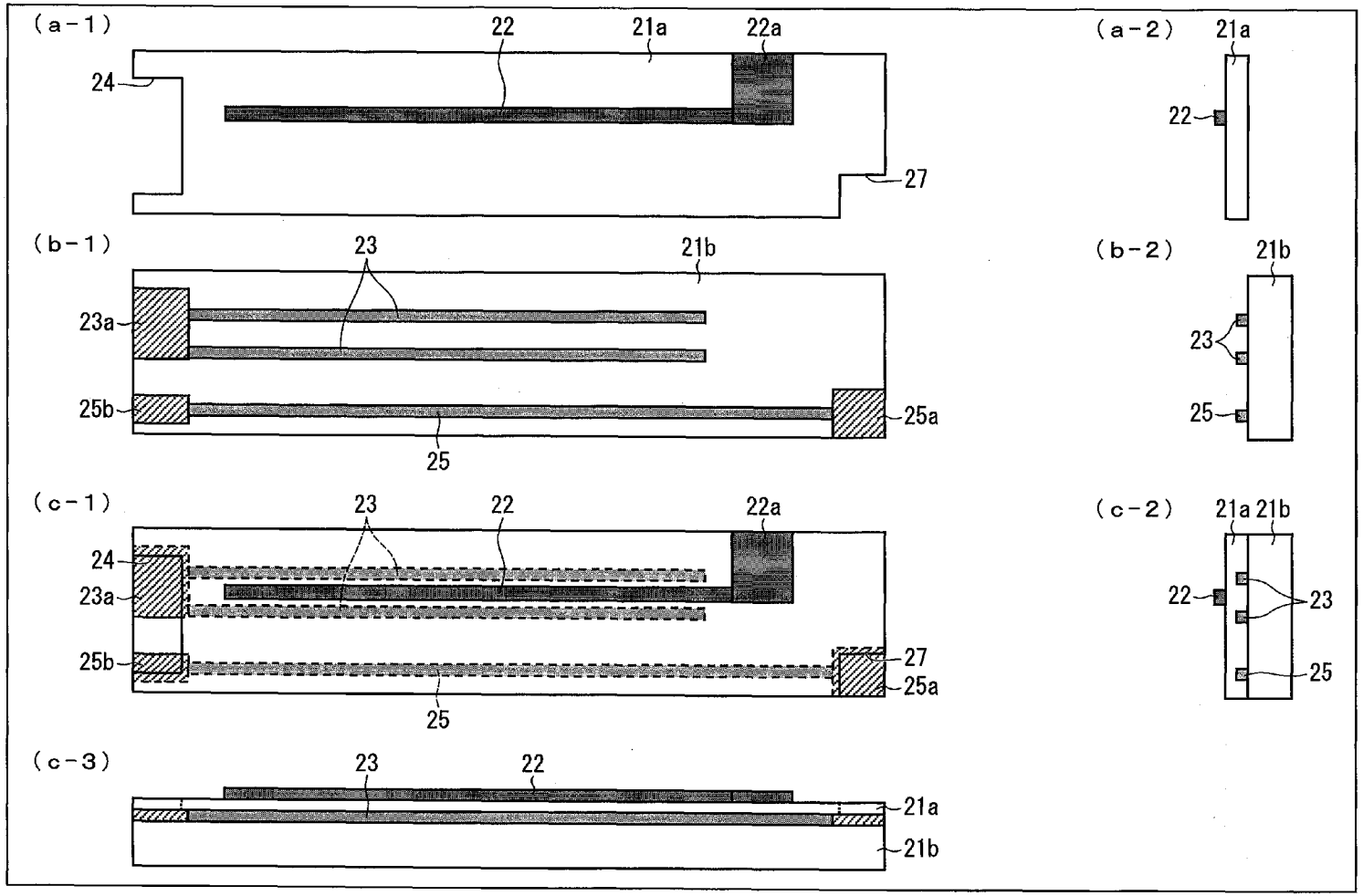
FIG. 5 illustrates an ion generating element of an example of the present invention; (a-1) and (a-2) of FIG. 5 are a front view and a side view of a dielectric layer; (b-1) and (b-2) of FIG. 5 are a front view and a side view of an insulating base material; and (c-1), (c-2), and (c-3) of FIG. 5 are a front view, a side view in a short direction, and a side view in a longitudinal direction, of the ion generating element of the example of the present invention.

The following explains about a method for producing the ion generating element 1 of the present embodiment, with reference to FIG. 5. However, the method for producing the ion generating element 1 of the present invention is not limited to the following method and the following values. Firstly, as illustrated in (a) of FIG. 5, a green sheet whose main components are alumina and glass and whose thickness is 0.2 mm is used as the dielectric layer 21*a*, and the discharge electrode 22 is formed thereon in a predetermined pattern by screen printing. As a material for the electrode, the aforementioned various materials can be used. However, in this embodiment, conductive paste containing gold (Au) as a main component of a conductive material and a glass component for making close contact with ceramic is used, for example. In the image forming apparatus 100 in which the ion generating element 1 of the present embodiment is used, it is necessary that the ion generating element 1 have a comparatively long size. For this reason, a ceramic material is preferably a low temperature co-fired ceramic (LTCC) material containing alumina and glass almost half and half. The reason is as follows. Since high temperature co-fired ceramic (HTCC) made from pure almina requires a high firing temperature, a very expensive and large firing furnace is required to realize a firing condition for maintaining a temperature distribution even. This will result in an increase in costs. In contrast, the LTCC is advantageous in that its firing temperature is low, and further preferable in that the LTCC allows stably producing, at low costs, an ion generating element having a comparative long size (large size).

Then, as illustrated in (b) of FIG. 5, a green sheet whose component is the same as above and whose thickness is 0.8 mm is used as the insulating base material 21*b*, and the induction electrode 23 and the heater electrode 25 are formed thereon in the same manner as above. Further, as illustrated in (a) of FIG. 5, openings 24 and 27 are preliminarily provided in the dielectric layer 21*a* at positions corresponding to (i) the ground terminal 23*a* of the induction electrode and the ground terminal 25*b* of the heater electrode and (ii) the power supply connection terminal 25*b* of the heater electrode, respectively. In the present embodiment, the opening 24*a* is provided as a single opening above the ground terminal 23*a* of the induction electrode and the ground terminal 25*b* of the heater electrode. However, as in Example 2 described later, an opening may be provided for each of the terminals.

Subsequently, as illustrated in (c) of FIG. 5, the dielectric layer 21*a* and the insulating base material 21*b* are laminated and attached to each other by pressure so that they are attached to each other in the right position and no air or foreign matter comes into between the layers. Then, the laminated body is cut out so as to be a predetermined size (for example, 6 mm in width by 320 mm in length), and fired in an electric furnace at 900 to 1000° C. In this way, the ion generating element 1 made from the ceramic material can be obtained.

A counter electrode 31 is made from stainless steel in a shaft shape, and is provided to have contact with a back side of the intermediate transfer belt 15 (a side on which a toner image is not formed) so that the counter electrode 31 faces the ion generating element 1 via the intermediate transfer belt 15. The counter electrode 31 is connected to the ground via a counter electrode power supply 35. The counter electrode power supply 35 is arranged so as to apply a predetermined voltage to the counter electrode 31. Such a counter electrode power supply 35 is provided so as to cause discharge to be easily generated from the discharge electrode 22. The counter electrode power supply 35 is not necessarily required, and may be omitted.

A high-voltage power supply (a voltage application circuit) 32 is controlled by a voltage control circuit 33 and supplies a voltage between the discharge electrode 22 and the induction electrode 23 of the ion generating element 1. The high-voltage power supply 32 employs a pulse wave, having a waveform shown in FIG. 11, of an application voltage Vpp of 2 to 4 kV, an offset bias of −1 to −2 kV, and a frequency f of 500 Hz to 2 kHz. A high-voltage-side-time duty of the pulse wave is arranged to be 10 to 50%. The waveform of the application voltage may be a sine wave. However, a pulse wave is more preferable, in consideration of a discharge efficiency and particularly a discharge performance under a high humidity condition. As the waveform shown in FIG. 11, overshoots at a rising edge and a falling edge are not necessary to be restrained, but rather may be used in a positive manner so that power supply costs may be able to be reduced in some cases.

When the high-voltage power supply 32 arranged as such is caused to operate so that an alternating high voltage is applied between the discharge electrode 22 and the induction electrode 23, creeping discharge (corona discharge) occurs in the vicinity of the discharge electrode 22 due to a potential difference between the discharge electrode 22 and the induction electrode 23. This ionizes an atmosphere around the discharge electrode 22 so that negative ions are generated, thereby charging a toner image formed on the intermediate transfer belt 15 to a predetermined charge amount (in this embodiment, about −30 μC/g).

Further, the high-voltage power supply 32 is connected to the voltage control circuit 33. The voltage control circuit 33 controls an application voltage level of the high-voltage power supply. More specifically, the voltage control circuit 33 measures a value of a current flowing in the counter electrode power supply 35, and carries out a feedback control of an application voltage of the high-voltage power supply 32 so that the measured value of the current becomes a target value. A value of a current flowing in the counter electrode 31 correlates to a charge amount of a toner image. Accordingly, by keeping the current flowing in the counter electrode 31 at a predetermined target value, the charge amount of a toner image is maintained at a predetermined value. As such, the feedback control is carried out with respect to the application voltage level of the high-voltage power supply 32 based on the value of the current flowing in the counter electrode 31. This makes it possible to constantly supply an optimal amount of ions to a toner image, even if a generation amount of ions varies or a percentage of generated ions that reaches a toner image varies due to a factor such as attachment of a foreign matter to a tip of the discharge electrode 22, a change in environmental conditions, or a change of a wind in the image forming apparatus 100. Such a control section by a counter electrode current is not necessarily required. The application voltage level may be controlled, by use of a control table prepared by examination in advance, depending on a surrounding environment, a degree of use for ages, information on a printing mode, or the like.

As described above, the ion generating element 1 of the present embodiment is arranged such that the induction electrode 23 and the heater electrode 25 are surrounded by the dielectric layer 21*a* and the insulating base material 21*b*. Accordingly, creeping leakage from the discharge electrode 22 to the induction electrode 23 or the heater electrode 25 hardly occurs, and Joule heat generated while a power is being supplied to the heater electrode 25 removes absorption moisture in the vicinity of the discharge electrode 22, thereby stabilizing a discharge performance. Since the arrangement is simple, it is possible to provide the element at low costs.

Further, in the ion generating element 1, the induction electrode 23 and the heater electrode 25 are provided away from each other so that the induction electrode 23 and the heater electrode 25 are insulated from each other. Consequently, even if a connection of the induction electrode 23 is floating (the induction electrode 23 is not connected to the ground, it is possible to avoid that an entire apparatus receives damages through the heater electrode 25. Since the leakage to the heater electrode 25 can be prevented, it is possible to prevent that the heater power supply 34 is damaged, thereby making it possible to prevent breakage, an accident of fire, and the like of a main body of a machine including the ion generating element 1. As a result, it is possible to provide an ion generating element that is excellent in terms of safety. Further, in the arrangement of the ion generating element 1, the dielectric layer 21*a* has a length covering the insulating base material 21*b*, thereby resulting in that even in case where some external forces are added to the ion generating element 1, it is possible to prevent that cracks of the element occur.

Figure 6:
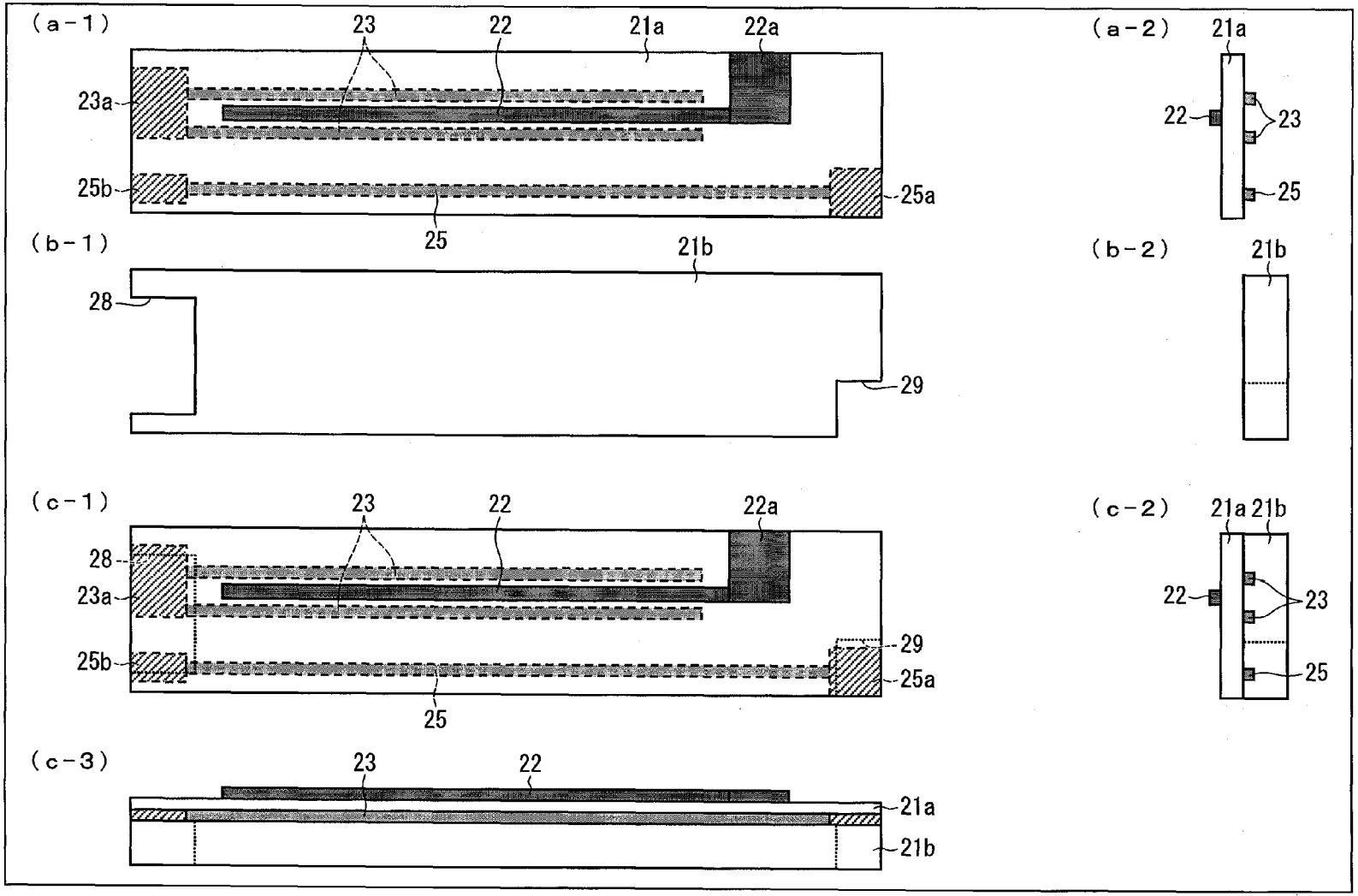
FIG. 6 illustrates an ion generating element in which openings are provided in an insulating base material: (a-1) and (a-2) of FIG. 6 are a front view and a side view of a dielectric layer; (b-1) and (b-2) of FIG. 6 are a front view and a side view of an insulating base material; and (c-1), (c-2), and (c-3) of FIG. 6 are a front view, a side view in a short direction, and a side view in a longitudinal direction, of the ion generating element in which openings are provided in an insulating base material.

In a case where an opening is provided in the insulating base material 21*b*, the strength of the element may be largely decreased. The reason will be explained as below, with reference to FIG. 6. From the viewpoint of the discharge characteristic, the dielectric layer 21*a* does not have a flexibility in terms of setting of its thickness, and further it is preferable that the dielectric layer 21*a* be formed thin to cause low voltage discharge. On the other hand, since the insulating base material 21*b* is comparatively flexible in terms of setting of its thickness, the insulating base material 21*b* may be formed so as to have a thickness to a certain degree to improve the strength of an ion generating element, in some cases. However, as illustrated in (b-1) and (b-2) of FIG. 6, if an opening 28 is provided in the insulating base material 21*b* that ensures the strength, it largely affects a decrease in strength of the entire element. Here, (b-1) of FIG. 6 is a plane view of the insulating base material 21*b* having an opening, and (b-2) of FIG. 6 is a side view thereof. Furthermore, the providing of the opening in the insulating base material 21*b* also largely affects a production method of the element. That is, a method in which wiring patterns for an induction electrode and a heater electrode are formed on an insulating base material and subsequently a dielectric layer is laminated thereon, or the like method cannot be adopted. For this reason, it is necessary that, as illustrated in (a-1) of FIG. 6, (i) the discharge electrode 22 be provided on one surface of the induction layer 21*a*, (ii) the induction electrode 23 and the heater electrode 25 be provided on the other surface of the induction layer 21*a*, and subsequently (iii) the dielectric layer 21*a* be laminated on the insulating base material 21*b*. Here, (a-1) of FIG. 6 is a plane view of the dielectric layer 21*a* on which each electrode is provided, and (a-2) of FIG. 6 is a side view thereof. In a case where an ion generating element is formed in the above manner and a ceramic substrate is used as the dielectric layer 21*a*, electrode patterns (the discharge electrode 22, the induction electrode 23, and the heater electrode 25) should be formed, by screen printing, on both sides of the comparatively-thin dielectric layer 21*a*. This easily causes problems such as defects of printed patterns, incorrect positioning of top and back sides, and the like. As such, in the case where an opening is provided in the insulating base material 21*b*, the above risks occur.

However, in the ion generating element 1 of the present embodiment, since an opening 24 is provided in the dielectric layer 21*a*, it is possible to provide a production method that requires low costs and has a high reliability. Further, since the opening is provided in the dielectric layer that is originally provided as a thin layer, effects on the decrease in strength of the entire element are small, compared with a case where an opening is provided in an insulting base material.

Example 1

Next explained are examples that employ the ion generating element of the present invention. The following deals with an ion generating element of a comparative example and an ion generating element of an example according to the present invention, by referring to FIGS. 4 and 5.

Figure 4:
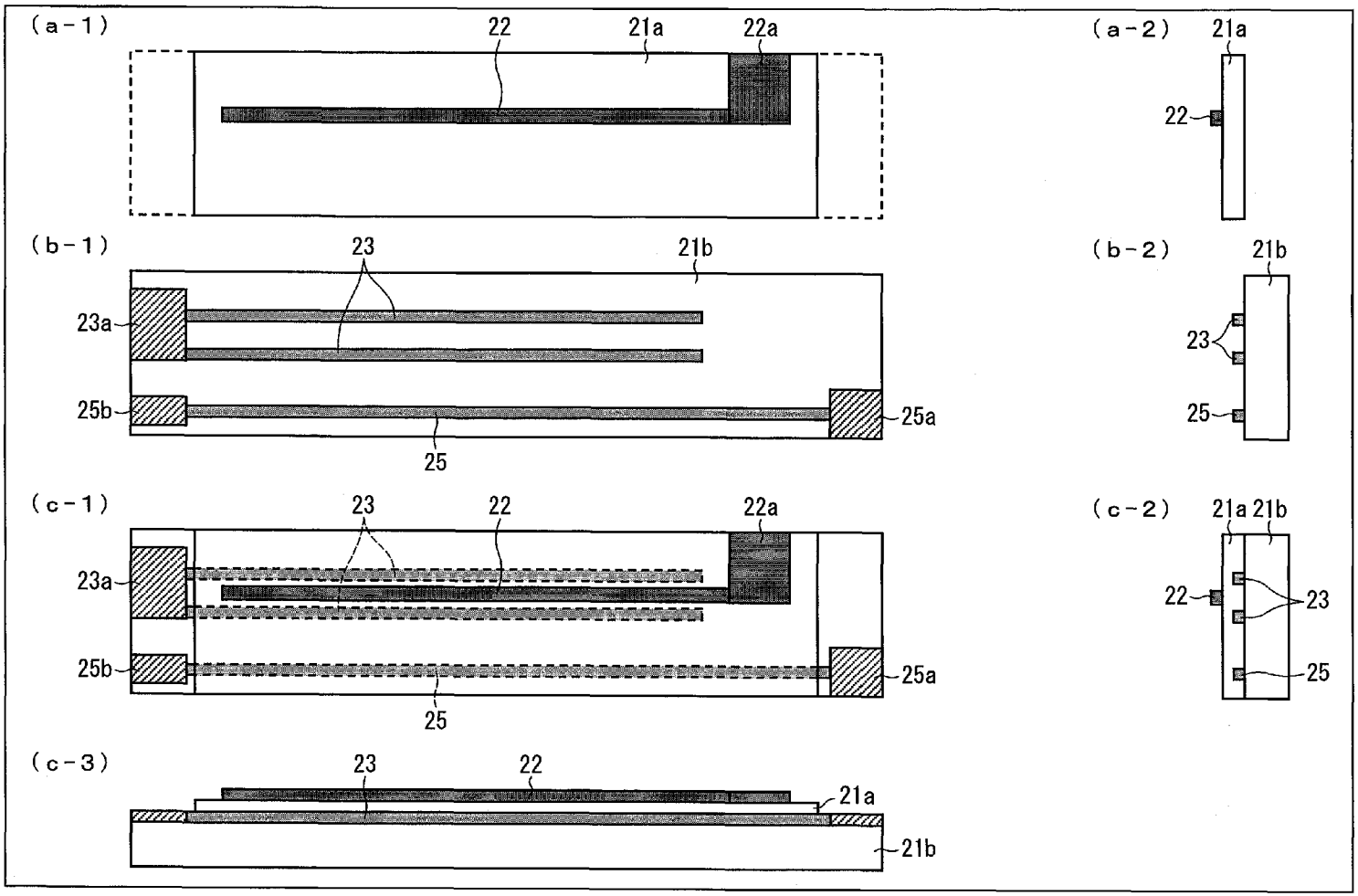
FIG. 4 illustrates an ion generating element of a comparative example: (a-1) and (a-2) of FIG. 4 are a front view and a side view of a dielectric layer; (b-1) and (b-2) of FIG. 4 are a front view and a side view of an insulating base material; and (c-1), (c-2), and (c-3) of FIG. 4 are a front view, a side view in a short direction, and a side view in a longitudinal direction, of the ion generating element of the comparative example.

FIG. 4 illustrates an ion generating element of the comparative example. As illustrated in (a-1) and (a-2) of FIG. 4, a ceramic sheet having a thickness of 0.2 mm is used as a dielectric layer 21*a*, and a predetermined pattern for a discharge electrode is formed thereon by screen printing. As an electrode material, paste mainly containing gold as a conductive material is used. The reason why gold is used is because little deterioration occurs after use for ages and a simple arrangement is possible because a coating layer is not necessary to be provided. Then, as illustrated in (b-1) and (b-2) of FIG. 4, a ceramic sheet having a thickness of 0.8 mm, whose components are the same as above, is used as an insulating base material 21*b*, and an induction electrode 23 and a heater electrode 25 are formed in the same manner as above. The induction electrode 23 and the heater electrode 25 are formed as patterns insulated from each other. Further, as illustrated in (a-1) of FIG. 4, both ends of the dielectric layer 21*a* are wholly cut along a width direction so that power feeding contacts of the induction electrode 23 and the heater electrode 25 on the insulating base material 21*b* are exposed. This allows feeding power at low costs with a simple structure, even though multiple power feeding contacts are provided. Then, as illustrated in (c-1) and (c-2) of FIG. 4, the dielectric layer 21*a* and the insulating base material 21*b* are laminated and attached to each other by pressure, and then fired so as to obtain the ion generating element of the comparative example.

The induction electrode 23 is constituted by two straight electrodes each having a width of 250 μm, which are aligned so as to sandwich the discharge electrode 22. Further, the heater electrode 25 has a width of 100 μm and its resistance value is approximately 20Ω. The discharge electrode 22 has a comb-like shape, as the one illustrated in (a) of FIG. 1. A line-shaped part at a center of the discharge electrode 22 has a width of 250 μm, each protrusion part in the discharge electrode 22 has a height of 100 μm and a width of 200 μm, and a pitch between protrusions of the discharge electrode 22 is 1 mm. A ground terminal 23*a* of the induction electrode and a ground terminal 25*b* of the heater electrode are provided separately, and connected to the ground potential. A power supply connection terminal 25*a* of the heater electrode 25 is connected to a heater power supply (12 V) of a main body of an image forming apparatus, via a switching element. As such, the arrangement of the ion generating element of the comparative example is most simple and can be provided at low costs.

In the above ion generating element of the comparative example, a ceramic material was used as the dielectric layer, and gold was used as the discharge electrode. This allowed the ion generating element to exhibit a stable discharge characteristic over a long period and to restrain occurrence of leakage to the induction electrode and the heater electrode that were internally provided. Further, in the arrangement, a heater function worked well and a stable discharge performance could be obtained in the high humidity environment. Further, it was observed that even in a case where the induction electrode had a poor contact with the ground, it was possible to prevent that the poor contact affected the main body of the apparatus through the heater electrode.

However, the arrangement of the ion generating element of the comparative example caused the following problem. Parts where the length of the dielectric layer 21*a* differs from that of the insulating base material 21*b* become stepwise along a width direction (a short direction) of the element. This may cause cracks of the element when the element is attached to or detached from the main body of the apparatus or when ceramic materials that have been distorted due to firing are incorporated with each other by correcting the distortion, because load is concentrated on the stepwise parts.

In view of the problem, examinations of an arrangement of an ion generating element of the present example (Example 1), as illustrated in FIG. 5, were carried out. The difference between the ion generating element of Example 1 and the one of the comparative example illustrated in FIG. 4 is a shape of an opening (an apertural area). Here, (a-1) and (a-2) of FIG. 5 are a front view and a side view of a dielectric layer 21*a* on which a discharge electrode 22 is provided. (b-1) and (b-2) of FIG. 5 are a front view and a side view of an insulating base material 21*b* on which an induction electrode 23 and a heater electrode 25 are provided. (c-1), (c-2), and (c-3) of FIG. 5 are a front view, a side view in a short direction, and a side view in a longitudinal direction, respectively, of an ion generating element of the present example in which the dielectric layer 21*a* illustrated in (a-1) and (a-2) of FIG. 5 and the insulating base material 21*b* illustrated in (b-1) and (b-2) of FIG. 5 are laminated. As illustrated in (a-1) of FIG. 5, the dielectric layer 21*a* has a length covering the insulating base material 21*b* and has openings 24 and 27 provided above a ground terminal 23*a* of the induction electrode and above a ground terminal 25*b* and a power supply connection terminal 25*a* of the heater electrode so that the terminals 23*a*, 25*b*, and 25*a* are exposed. In the present example, the opening 24 is provided as a single opening above the ground terminal 23*a* of the induction electrode and the ground terminal 25*b* of the heater electrode.

As illustrated in (c-1) of FIG. 5, no step along a width direction (a short direction) was formed and it was observed that occurrence of cracks during handling the device could be effectively restrained. In the ion generating element of the present example illustrated in FIG. 5, the openings 24 and 27 have a rectangular shape. However, in a case where corners of each of the openings 24 and 27 are formed in a circular arc shape, it is possible to further prevent stress concentration. On this account, the circular arc shape is more preferable to improve the strength and reliability of the element.

Example 2

Figure 7:
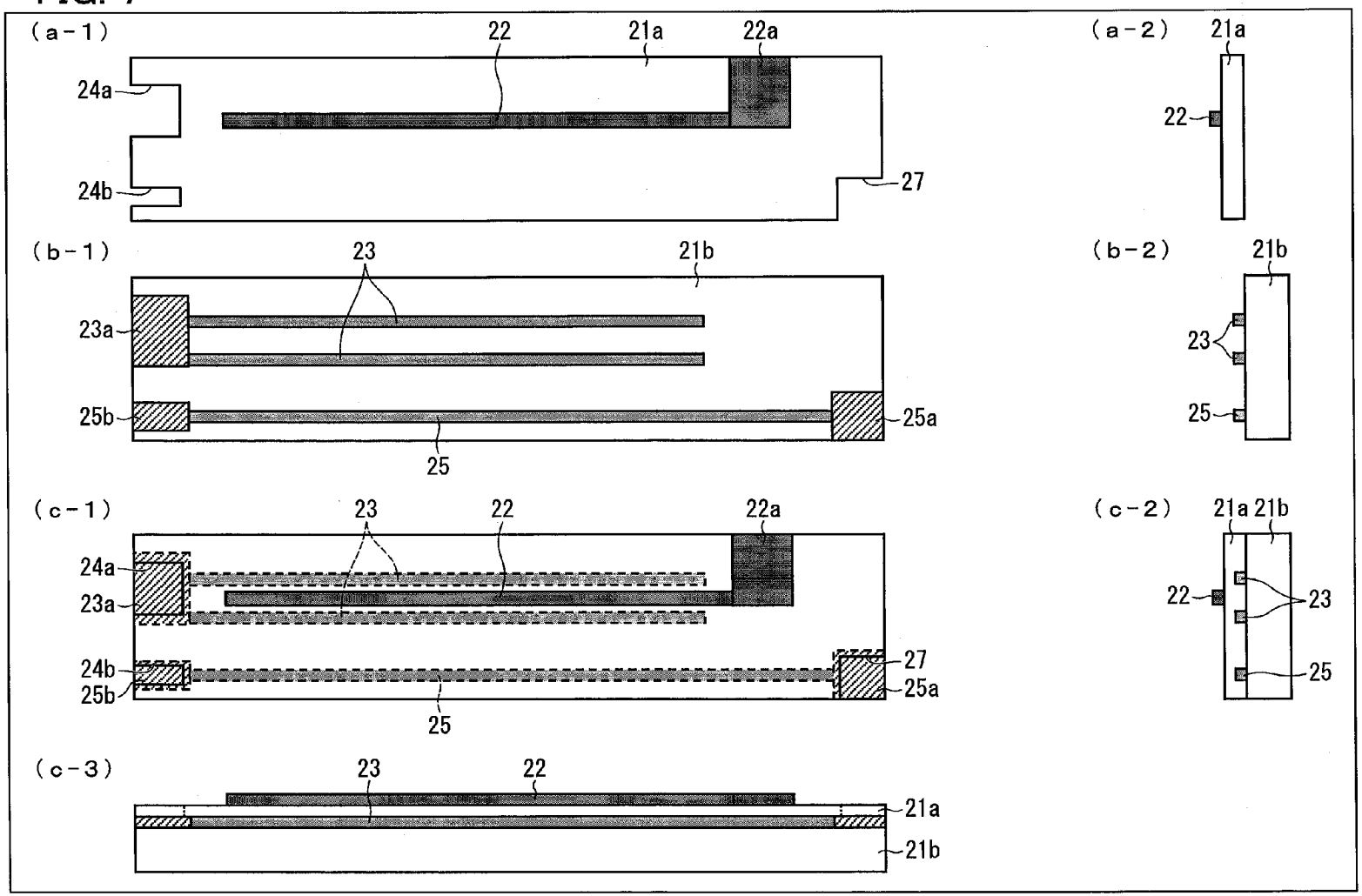
FIG. 7 illustrates an ion generating element of another example of the present invention: (a-1) and (a-2) of FIG. 7 are a front view and a side view of a dielectric layer; (b-1) and (b-2) of FIG. 7 are a front view and a side view of an insulating base material; and (c-1), (c-2), and (c-3) are a front view, a side view in a short direction, and a side view in a longitudinal direction, of the ion generating element of the another example of the present invention.
Figure 8:
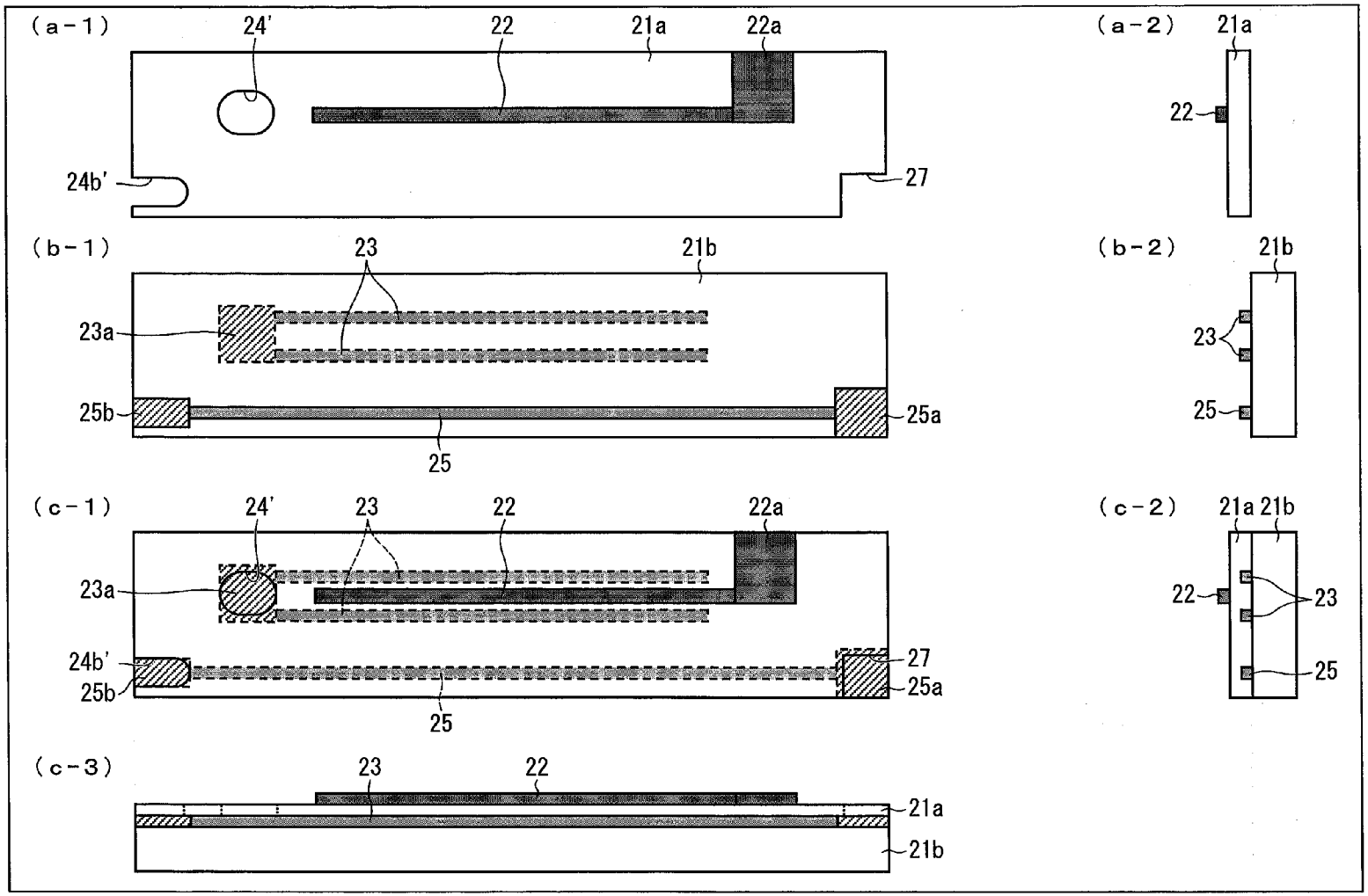
FIG. 8 illustrates an ion generating element as a modified example of the ion generating element illustrated in FIG. 7: (a-1) and (a-2) of FIG. 8 are a front view and a side view of a dielectric layer; (b-1) and (b-2) of FIG. 8 are a front view and a side view of an insulating base material; and (c-1), (c-2), and (c-3) of FIG. 8 are a front view, a side view in a short direction, and a side view in a longitudinal direction, of the ion generating element of the modified example.
Figure 9:
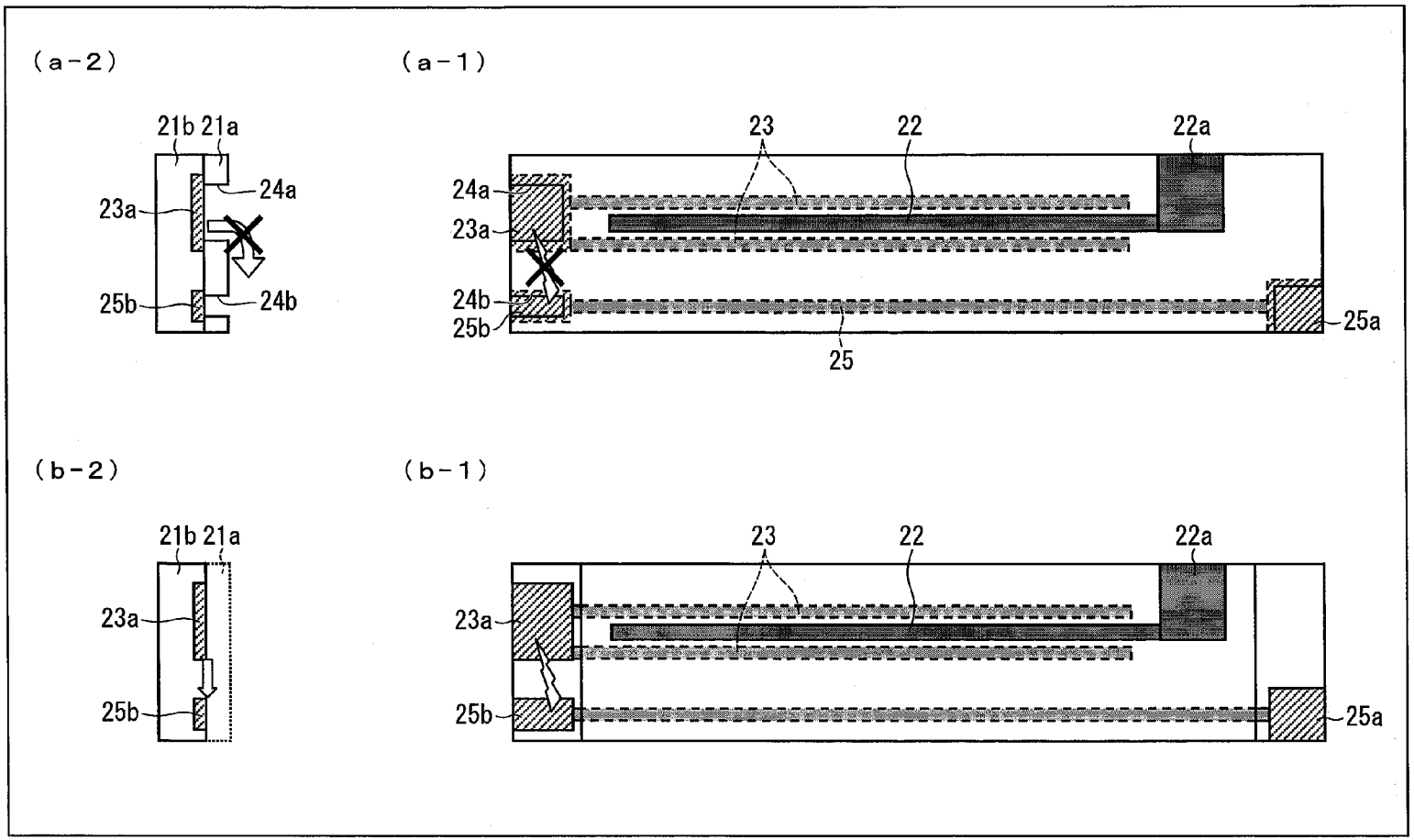
FIG. 9 (a-1) and (a-2) of FIG. 9 illustrate that a dielectric layer lies between openings; and (b-1) and (b-2) of FIG. 9 illustrate creeping leakage or ion migration.
Figure 10:
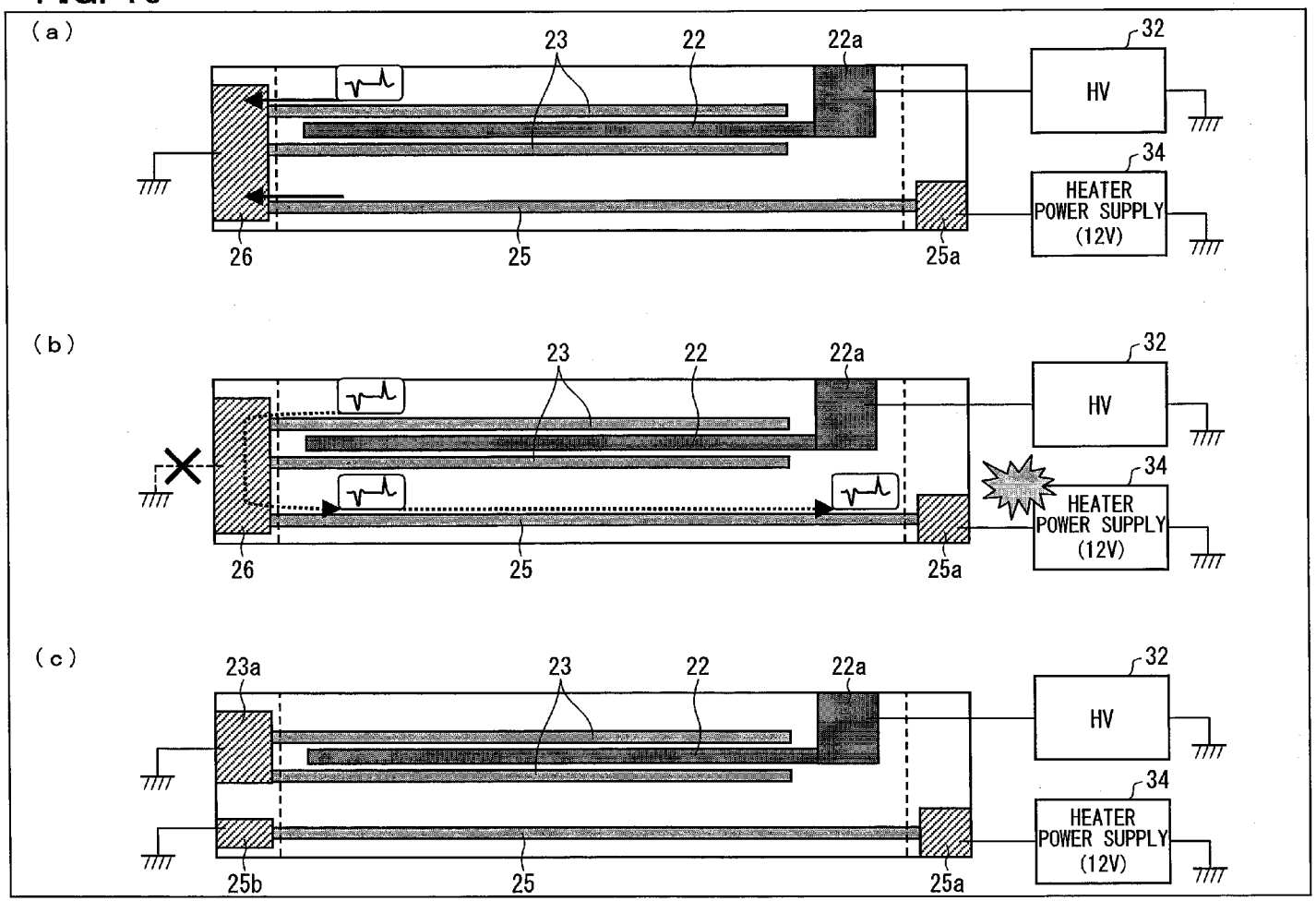
FIG. 10 (a) of FIG. 10 is a front view illustrating an ion generating element in which an induction electrode and a heater electrode share a ground terminal; (b) of FIG. 10 illustrates that the ion generating element of (a) of FIG. 10 is floating; and (c) of FIG. 10 is a front view illustrating an ion generating element in which an induction electrode and a heater electrodes have individual ground terminals.
Figure 11:
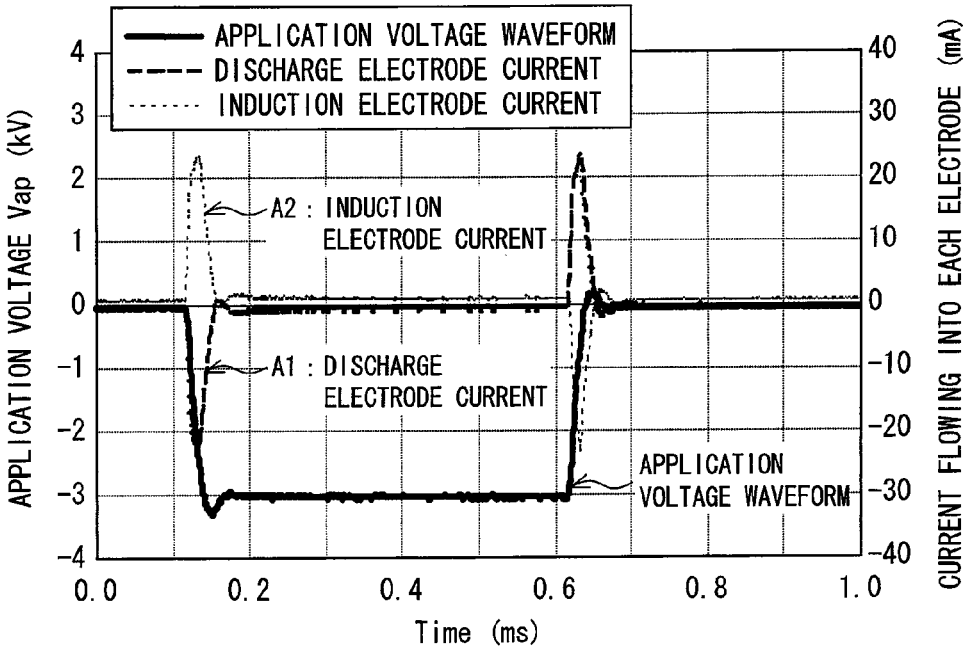
FIG. 11 shows an application voltage waveform and waveforms of currents flowing into a discharge electrode and an induction electrode in an ion generating element to which a pulsing voltage is being applied.

The following deals with another example of the ion generating element of the present invention, with reference to FIGS. 7 through 9.

An ion generating element of the present example (Example 2) is arranged in the same manner as the arrangement of the ion generating element of Example 1, except that a dielectric layer 21*a* has openings separately provided for a ground terminal 23*a* of an induction electrode and a ground terminal 25*b* of a heater electrode, respectively, as illustrated in FIG. 7. That is, individual openings (openings 24*a* and 24*b*) are provided above the ground terminal 23*a* of the induction electrode and above the ground terminal 25*b* of the heater electrode, respectively. Here, (a-1) and (a-2) of FIG. 7 are a front view and a side view of a dielectric layer having the individual openings on which layer a discharge electrode 22 is provided. (b-1) and (b-2) of FIG. 7 are a front view and a side view of an insulating base material 21*b* on which an induction electrode 23 and a heater electrode 25 are provided. Further, (c-1), (c-2), and (c-3) of FIG. 7 are a front view, a side view in a short direction, and a side view in a longitudinal direction, respectively, of an ion generating element of the present example in which the dielectric layer 21*a* illustrated in (a-1) and (a-2) of FIG. 7 and the insulating base material 21*b* illustrated in (b-1) and (b-2) of FIG. 7 are laminated.

Moreover, FIG. 8 is a modified example of the ion generating element illustrate in FIG. 7. An ion generating element of FIG. 8 is one in which terminals are provided so as to be dislocated in a longitudinal direction because a width of the element is narrowed or the like and two terminals cannot be aligned in a width direction (a short direction) of the element. Further, in the ion generating element illustrated in FIG. 8, an opening 24*a*' facing a ground terminal 23*a* of an internally-provided induction electrode and an opening 24*b*' facing a ground terminal 25*b* of an internally-provided heater electrode are formed in an oval shape. Here, (a-1) and (a-2) of FIG. 8 are a front view and a side view of a dielectric layer 21*a* in which the individual openings 24*a*' and 24*b*' are provided in an oval shape and a discharge electrode is provided. (b-1) and (b-2) of FIG. 8 are a front view and a side view of an insulating base material 21*b* in which an induction electrode 23 and a heater electrode 25 are provided. Further, (c-1), (c-2), and (c-3) of FIG. 8 are a front view, a side view in a short direction, and a side view in a longitudinal direction, respectively, of an ion generating element of a modified example of the present example, in which the dielectric layer 21*a* illustrated in (a-1) and (a-2) of FIG. 8 and the insulating base material 21*b* illustrated in (b-1) and (b-2) of FIG. 8 are laminated. The following deals with effects and advantages of the arrangements of the present example and its modified example.

In cases where many generation amounts of ions are required, a thickness of a dielectric layer is increased in view of an improvement in strength, a discharge characteristic is to be stabilized even when an ion generating element is deteriorated due to use for ages, and the like cases, it is necessary to increase a level of a voltage applied to the discharge electrode 22. Further, in a case where a width of an element is decreased to downsize the element or to reduce costs by an increase in yield rate in production, there may be a case where a distance between the ground terminal 23*a* of the induction electrode 23 and the ground terminal 25*b* of the heater electrode 25 becomes narrow. In such a case, if the ground terminal 23*a* of the induction electrode is floating from the ground potential, an induction electrode potential may be affected by a discharge electrode potential and increased. This may involve the risk of leakage from the ground terminal 23*a* of the induction electrode to the ground terminal 25*b*, adjoining to the ground terminal 23*a*, of the heater electrode, depending on a degree of the increase of the induction electrode potential.

In the cases of the arrangement of the aforementioned ion generating elements of the comparative example illustrated in FIG. 4 and Example 1 illustrated in FIG. 5, a part between the electrodes is plane, as illustrated in (b-1) and (b-2) of FIG. 9. In this case, if there is moisture or the like between the terminals, a resistance on a creepage surface decreases, thereby easily causing creeping leakage.

However, in the ion generating elements of the present example and its modified example, the dielectric layer is provided between the openings 24*a* and 24*b*, as illustrated in (a-1) and (a-2) of FIG. 9. In this case, the terminals are insulated by the dielectric layer, thereby hardly causing creeping leakage. As a result, with the ion generating elements of the present example and its modified example, it is possible to provide an element that more surely assures its safety. Further, since an area of the opening 24 of the dielectric layer 21*a* is small, the strength of the element is improved. In this respect, the arrangements of the ion generating elements of the present example and its modified example are more preferable.

Example 3

Further another example of the ion generating element of the present invention is explained as below. Although an ion generating element of the present example has the same structure illustrated in FIG. 6 or 7, an induction electrode and a heater electrode are entirely made from silver palladium. The following explains about effects and advantages of the case where these electrodes are made from silver palladium.

As an advantage of the case where the induction electrode 23 and the heater electrode 25 are made from gold paste, it is possible to obtain a stable contact point without plating or the like treatment because a contact point part is also made from gold. However, a disadvantage of this case is high production costs. Further, the heater electrode made from gold has an extremely low resistance. Therefore, in a case where resistance of the heater electrode is set to a predetermined value, especially, a high value, it is necessary that the heater electrode be formed to have a very thin line width or formed in a multiple-loop pattern so as to be long. The case where the heater electrode is formed in such a pattern involves a high risk of breaking of a wiring line due to defects in production processes, which causes a decrease in production yield and further an increase in costs.

In order to prevent the increase in costs, silver paste can be used. The silver material is preferable in that a designing range of the heater electrode is wide and can restrain occurrence of defects because the silver material costs less and has higher resistance than gold. However, in the case of the silver material, poor insulation due to ion migration should be taken into consideration. The ion migration is a phenomenon that, in a case where an electric field is caused between a plurality of electrodes in a high humidity environment, silver is ionized and moves between the electrodes and precipitated silver causes short-circuits between the electrodes. The ion migration is easily promoted in a plane part. In the arrangements of the ion generating elements of the comparative example illustrated in FIG. 4 and Example 1 illustrated in FIG. 5, assume a case where the silver material is used for the heater electrode 25. In this case, when the induction electrode is floating in a high humidity environment and an electric field is generated between the induction electrode and the heater electrode, the ion migration is easily promoted, as illustrated in (b-1) and (b-2) of FIG. 9, because a part between the electrodes is plane. For this reason, although the induction electrode 23 and the heater electrode 25 that are to be internally provided between the insulating base material 21*b* and the dielectric layer 21*a* can be made from the silver material, a contact point part should be treated with gold plating or the like. This causes an increase in costs.

On the other hand, in the arrangements illustrated in FIGS. 6 and 7, the dielectric layer between the openings 24*a* and 24*b* of the dielectric layer 21*a* becomes stepwise, as illustrated in (a-1) and (a-2) of FIG. 9. This restrains the promoting of the ion migration and prevents short-circuits. As a result, it is possible to produce, at low costs, a high-quality ion generating element of the present example.

Moreover, the use of paste containing not only silver but also palladium can further restrain the ion migration. The palladium may be contained as powder mixed with silver, but it is further preferable that the palladium be alloyed with silver. The content of the palladium is preferably not less than 3% to 5%, and may be selected as appropriated depending on costs and a resistance characteristic.

As described above, an ion generating element of the present invention is an ion generating element for generating ions along with creeping discharge while an alternating voltage is being applied between a discharge electrode and an induction electrode, which are provided so as to sandwich a dielectric layer, and the ion generating element includes a heater electrode for heating the ion generating element with Joule heat generated while a power is supplied to the heater electrode, the heater electrode and the induction electrode being provided away from each other on one surface of an insulating base material so that the heater electrode and the induction electrode are insulated from each other, the dielectric layer being laminated on the surface of the insulating base material, the dielectric layer having a length covering the insulating base material and the dielectric layer having openings above a terminal of the induction electrode and above terminals of the heater electrode so that the terminals are exposed.

In the arrangement of the present invention, the induction electrode and the heater electrode are surrounded by the dielectric layer and the insulating base material. As a result, creeping leakage from the discharge electrode to the induction electrode or the heater electrode hardly occurs, thereby resulting in that it is possible to stabilize a discharge performance by removing absorption moisture by Joule heat generated while a power is being supplied to the heater electrode. Further, since the arrangement is simple, it is possible to provide the element at low costs.

Moreover, in the arrangement of the present invention, the induction electrode and the heater electrode are provided away from each other so that the induction electrode and the heater electrode are insulated from each other.

Here, assume a case where an induction electrode and a heater electrode share a terminal at one edges thereof and the terminal is connected to a given potential such as the ground potential. In such a case, when the terminal is electrically disconnected due to some reasons and a high voltage is being applied to a discharge electrode, a heater power supply section may be damaged in some cases. That is, in a state where the induction electrode is not directly connected to the given potential (the ground potential or the like), if a high voltage is applied to the discharge electrode, a potential of the induction electrode is affected by the high voltage applied to the discharge electrode, and is changed. The change in the potential of the induction electrode further affects, as a noise, the heater power supply section through the heater electrode. Since a voltage at the heater power supply section is very low, compared with the voltage applied to the discharge electrode, the noise greatly affects the heater power supply section. Furthermore, in a case where a common power supply of an apparatus including an ion generating element is also used as a heater power supply, it is possible to reduce costs. However, if the above troubles occur, the entire apparatus is damaged, which causes a great loss. In the worst case, fire or the like safety problem may occur.

However, in the present invention, the induction electrode and the heater electrode are provided away from each other so that they are insulated from each other. In this case, even when a connection of the induction electrode is floating (for example, the induction electrode is not connected to the ground or to an intended potential supply section), it is possible to avoid that an entire apparatus is damaged through the heater electrode. Further, since leakage to the heater electrode can be prevented as such, it is possible to prevent that the heater power supply is damaged and that a main body of a machine including the ion generating element is broken or fired. As a result, it is possible to provide an ion generating element that is excellent in terms of safety.

Moreover, in the arrangement of the present invention, since the dielectric layer has a length covering the insulating base material, no step is formed along a width direction of the element. As a result, even if some external forces are added to the ion generating element, it is possible to prevent occurrence of cracks of the element. Further, the dielectric layer has openings above a terminal of the induction electrode and above terminals of the heater electrode so that the terminals are exposed.

There are some arrangements for causing electrical connection to the induction electrode and a heater section that are sandwiched between the dielectric layer and the insulating base material. One of the arrangements is, for example, that through halls are formed and terminals are provided on a surface of a dielectric layer on which surface a discharge electrode is provided or on a surface of an insulating base material on which surface no electrode is provided. However, the formation of the through halls requires another process, which causes an increase in costs. Further, in a case where an opening is provided in the insulating base material, the strength of the element may be largely decreased. The dielectric layer is not largely flexible in terms of its setting of a thickness from the viewpoint of its discharge characteristic, and is preferable to be thin to cause discharge at low voltage. On the other hand, the insulating base material is comparatively flexible in terms of its setting of a thickness. For this reason, the insulating base material may have a thickness to a certain degree to improve the strength of the element. However, if an opening is formed in an insulating base material side that ensures the strength, the strength of the entire element is largely affected. Furthermore, in the case where an opening is formed in the insulating base material side, a production method of the element is largely affected. That is, a method cannot be used in which a dielectric layer is laminated on an insulating base material after wiring patterns for an induction electrode and a heater electrode are formed on the insulating base material. In this case, it is necessary that the insulating base material be laminated on the dielectric layer after (i) a pattern for a discharge electrode is formed on one surface of the dielectric layer and (ii) an induction electrode and a heater electrode are formed on the other surface of the dielectric layer. However, in a case where ceramic or the like is used for the dielectric layer, electrode patterns should be formed, by screen printing or the like, on both side of such a comparative thin dielectric layer. This involves risks of easy occurrence of defects of printed patterns, incorrect positioning of top and back sides, and the like.

In comparison with such arrangements, in the present invention, the dielectric layer has openings above the terminal of the dielectric electrode and above the terminals of the heater electrode. This does not cause the above problems, and makes it possible to provide, at low costs, an ion generating element having high reliability. Moreover, since openings are provided in the dielectric layer that is originally thin, effects on the decrease in strength of the entire element are small, compared with a case where openings are provided in the insulating base material.

As described above, with the arrangement of the present invention, it is possible to provide, at low costs, an ion generating element (i) that prevents damages when unexpected troubles occur and (ii) that is excellent in terms of safety.

In addition to the above arrangement, in the ion generating element of the present invention, each of the openings of the dielectric layer may be provided for each of the terminals, separately.

In a case where a terminal of a dielectric layer is floating, a potential of an induction electrode largely increases while a high voltage is being applied to a discharge electrode. In this case, if a terminal of a heater electrode is provided close to the induction electrode, creeping leakage may occur. However, in the arrangement of the present invention, individual openings are provided in the dielectric layer for the terminals, respectively. Accordingly, the dielectric layer lies between the terminals, thereby making it possible to prevent occurrence of creeping leakage. Furthermore, the arrangement of the present invention is preferable in terms of ensuring the strength of the element, because the openings can be formed in a minimum necessary size.

In addition to the above arrangement, in the ion generating element of the present invention, the terminal of the induction electrode may be a ground terminal and the terminals of the heater electrode may be a heater power supply connection terminal and a ground terminal.

In the arrangement, the terminal of the induction electrode can be connected to the ground potential, and one of the terminals of the heater electrode can be connected to a heater power supply while the other one of the terminals of the heater electrode can be connected to the ground potential. As a result, it is possible to more easily arrange electrodes including terminals, thereby resulting in that an ion generating element can be easily produced at low costs.

In addition to the above arrangement, in the ion generating element of the present invention, a main component of a conductive material of the discharge electrode may be gold.

With the arrangement, it is possible to obtain a stable discharge performance over a long period. This is because the discharge electrode whose main component of a conductive material is gold has high resistance to oxidation caused due to occurrence of ozone along with discharge and a change in electric properties as a discharge electrode is small. That is, since the discharge electrode whose main component of a conductive material is gold has high resistance as an electrode, it is not necessary to separately provide a protective coating layer for the discharge electrode, thereby resulting in that the ion generating element can be produced with a simple arrangement. Further, it is possible to avoid a risk of uneven discharge due to unevenness in a coating layer or due to deterioration of the coating layer because of use for ages. From these reasons, the above arrangement of the present invention is more preferable.

In addition to the above arrangement, in the ion generating element of the present invention, a main component of a conductive material of the induction electrode and the heater electrode may be a mixture or an alloy of silver and palladium.

A material of the induction electrode and the heater electrode may be one in which a conductive material is mainly made from a material other than gold. From the viewpoint of a decrease in costs, it is preferable that the induction electrode and the heater electrode be made from a cheap material other than gold.

Further, from the viewpoint of suppressing power supply costs, it is preferable that a common voltage (5, 12, 24 V) of an apparatus including a heater power supply can be used for the heater electrode. However, in such a case, in order to obtain a desired input voltage, it is necessary to control resistance of the heater electrode to a predetermined range. In a case where the heater electrode is made from a material whose main component is gold, its resistance becomes extremely low. If a desired resistance is relatively high, the heater electrode should be formed to have a long wiring length and a thin line width. However, such a wiring pattern may cause breaking of a wiring line in a production process, thereby resulting in that a production yield may be decreased and costs may increase in addition to costs for an expensive gold material.

In view of this problem, it is preferable that a silver material be used as a conductive material of the induction electrode and the heater electrode. In a case where such a silver material is used, resistance of the electrodes can be easily increased compared with a case where the gold material is used, and it is possible to improve the risk of breaking of a wiring line caused when a wiring pattern is formed to have an extremely thin line width. Furthermore, in a case where the insulating base material and the dielectric layer are made from ceramic, glass, or the like material, it is necessary to carry out firing at a high temperature. Even in such a case, since the silver material has high heat resistance, the combination of these materials is desirable. However, in the case where the silver material is used, there may occur poor insulation due to occurrence of ion migration. A state in which the ion migration easily occurs is, for example, a state in which an electric field affects between adjacent electrodes in a high humidity environment and development, precipitating growth, or the like of silver ions is hardly disturbed in a plane surface. That is, the ion migration easily occurs in a case where (i) the ion generating element is used in a high humidity environment, (ii) the connection of the induction electrode becomes poor, (iii) a potential of the induction electrode is affected by a discharge electrode potential and increased, thereby increasing an electric field intensity between the induction electrode and the heater electrode adjoining each other, and (iv) contact points of the induction electrode and the heater electrode are close to each other in the same plane surface.

However, in the arrangement of the present invention, the dielectric layer lies between the induction electrode and the heater electrode such that the dielectric layer becomes stepwise at the terminals. This can prevent the migration. For this reason, it is possible to use the silver material. Further, a mixture or an alloy in which at least around 5% of palladium is mixed or alloyed with silver is more preferably used so that the occurrence of the migration is restrained.

In addition to the arrangement, in the ion generating element of the present invention, the dielectric layer or the insulating base material may be mainly made from ceramic or glass.

It is preferable that a ceramic or glass material be used for the dielectric layer lying between the discharge electrode and the induction electrode, from the viewpoint of stability of an insulating performance and an electric characteristic of the dielectric layer. Further, it is preferable that (i) the insulating base material also be made from a ceramic or glass material similarly to the dielectric layer and (ii) the insulating base material and the dielectric layer be fired in an integrated manner. This is because the induction electrode and the heater electrodes can be embedded within the ceramic or glass material, thereby more increasing the insulating performance with respect to creeping leakage. The ceramic or glass material may be cracked. However, since the ion generating element of the present invention is arranged so as to maintain the strength of the element, it is possible to maintain the strength of the element even if the insulating base material and the dielectric layer are made from the ceramic or glass material. Besides, it is possible to obtain the above effects due to the use of the ceramic or glass material, thereby allowing the ion generating element to carry out a higher performance.

In order to achieve the above object, a charging device of the present invention includes any one of the ion generating devices, a high-voltage power supply section for applying an alternating voltage between the discharge electrode and the induction electrode, and a power supply section for applying a voltage to the heater electrode.

With the arrangement, since the charging device includes the ion generating element of the present invention, it is possible to prevent damages to a heater power supply. As a result, it possible to provide a safe and compact charging device.

An image forming apparatus of the present invention may includes the charging device as a pretransfer charging device for giving electric charge to toner carried on a bearing member.

When the charging device of the present invention is used as a pretransfer charging device, it is possible to prevent damages to a heater power supply of the charging device and breaking of a main body of the image forming apparatus. As a result, it is possible to provide a safe image forming apparatus. Furthermore, as has been already described, the charging device of the present invention is compact. Therefore, it is possible to charge toner that has not been transferred, within a limited space, thereby resulting in that the image forming apparatus can be downsized.

An image forming apparatus of the present invention may include the charging device as a charging device for charging an electrostatic latent image bearing member.

When the charging device of the present invention is used as a charging device for charging an electrostatic latent image bearing member, it is possible to prevent damages to a heater power supply of the charging device and breaking of a main body of the image forming apparatus. As a result, it is possible to provide a safe image forming apparatus. Moreover, as has been already described, since the charging device of the present invention is compact, it is possible to provide a compact image forming apparatus.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

Industrial Applicability

The present invention can be used as a charging device, in an image forming apparatus employing an electrophotographic method, for carrying out (i) pretransfer charging by which a toner image to be formed on an image bearing member such as a photoreceptor or an intermediate transfer member is charged before a transfer, (ii) latent image charging by which a photoreceptor is charged, (iii) toner precharging by which charging of toner contained in a developing device is supplemented, or the like charging.

What is claimed is:

1. An ion generating element for generating ions along with creeping discharge while an alternating voltage is being applied between a discharge electrode and an induction electrode, which are provided so as to sandwich a dielectric layer therebetween, comprising:

a heater electrode for heating the ion generating element with Joule heat generated while a power is being supplied to the heater electrode, the heater electrode and the induction electrode being provided away from each other on one surface of an insulating base material such that the heater electrode and the induction electrode are insulated from each other, the dielectric layer being laminated on the surface of the insulating base material, the dielectric layer having a length covering the insulating base material and the dielectric layer having openings above a terminal of the induction electrode and above terminals of the heater electrode so that the terminals are exposed.

2. The ion generating element as set forth in claim 1, wherein each of the openings of the dielectric layer is provided for each of the terminals, separately.

3. The ion generating element as set forth in claim 1, wherein:

the terminal of the induction electrode is a ground terminal and the terminals of the heater electrode are a heater power supply connection terminal and a ground terminal.

4. The ion generating element as set forth in claim 1, wherein a main component of a conductive material of the discharge electrode is gold.

5. The ion generating element as set forth in claim 1, wherein a main component of a conductive material of the induction electrode and the heater electrode is a mixture or an alloy of silver and palladium.

6. The ion generating element as set forth in claim 1, wherein the dielectric layer and the insulating base material are mainly made from ceramic or glass.

7. A charging device comprising:

an ion generating element for generating ions along with creeping discharge while an alternating voltage is being applied between a discharge electrode and an induction electrode, which are provided so as to sandwich a dielectric layer therebetween; and a power supply section for applying an alternating voltage between the discharge electrode and the induction electrode, said ion generating device including a heater electrode for heating said ion generating device with Joule heat generated while a power is being supplied to the heater electrode, the heater electrode and the induction electrode being provided away from each other on one surface of an insulating base material such that the heater electrode and the induction electrode are insulated from each other, the dielectric layer being laminated on the surface of the insulating base material, the dielectric layer having a length covering the insulating base material and the dielectric layer having openings above a terminal of the induction electrode and above terminals of the heater electrode so that the terminals are exposed.

8. An image forming apparatus comprising a charging device as set forth in claim 7 as a pretransfer charging device for giving electric charge to toner carried on a bearing member.

9. An image forming apparatus comprising a charging device as set forth in claim 7 as a charging device for charging an electrostatic latent image bearing member.

* * * * *